US012195991B2

(12) United States Patent
Springborn

(10) Patent No.: US 12,195,991 B2
(45) Date of Patent: Jan. 14, 2025

(54) FENCING ASSEMBLY

(71) Applicant: UFP Industries, Inc., Grand Rapids, MI (US)

(72) Inventor: Russell Harry Springborn, Howell, MI (US)

(73) Assignee: UFP Industries, Inc., Grand Rapids, MI (US)

( * ) Notice: Subject to any disclaimer, the term of this patent is extended or adjusted under 35 U.S.C. 154(b) by 472 days.

(21) Appl. No.: 17/676,336

(22) Filed: Feb. 21, 2022

(65) Prior Publication Data

US 2022/0170290 A1 Jun. 2, 2022

Related U.S. Application Data

(63) Continuation of application No. 16/216,678, filed on Dec. 11, 2018, now Pat. No. 11,286,687.
(Continued)

(51) Int. Cl.
*E04H 17/16* (2006.01)
*E04H 17/14* (2006.01)

(52) U.S. Cl.
CPC ..... *E04H 17/168* (2013.01); *E04H 17/1404* (2013.01); *E04H 17/1417* (2013.01);
(Continued)

(58) Field of Classification Search
CPC ... E04H 17/16; E04H 17/1602; E04H 17/165; E04H 17/166; E04H 17/168; E04H 17/14;
(Continued)

(56) References Cited

U.S. PATENT DOCUMENTS 2,955,806 A 10/1960 Block
3,157,255 A 11/1964 Sondheim
(Continued)

FOREIGN PATENT DOCUMENTS

CA 2142402 A1 8/1996
CA 2488686 A1 * 5/2006 ..... E04H 17/168
(Continued)

*Primary Examiner* — Jonathan P Masinick
(74) *Attorney, Agent, or Firm* — Mc Garry Bair PC

(57) ABSTRACT

Various embodiments of the present disclosure can include a fencing assembly. In some embodiments, the fencing assembly can include a top cross-member including a first channel. In some embodiments, the fencing assembly can include a bottom cross-member including a second channel that opposes the first channel. In some embodiments, the fencing assembly can include a first vertical support member, wherein the first vertical support member is connected to a first end of the top cross-member and a first end of the bottom cross-member. In some embodiments, the fencing assembly can include a second vertical support member, wherein the second vertical support member is connected to a second end of the top cross-member and a second end of the bottom cross-member. In some embodiments, the fencing assembly can include a planar barrier, wherein the planar barrier is inserted into the first channel and the second channel and is confined on a first and second side of the planar barrier by the first vertical support member and the second vertical support member.

20 Claims, 29 Drawing Sheets

Related U.S. Application Data

(60) Provisional application No. 62/598,307, filed on Dec. 13, 2017.

(52) U.S. Cl.
CPC ..... *E04H 17/145* (2021.01); *E04H 17/1602* (2021.01); *E04H 17/1465* (2021.01)

(58) Field of Classification Search
CPC ..... E04H 17/1413; E04H 17/1417; E04H 17/1426; E04H 17/1439; E04H 17/1447; E04H 17/1465
See application file for complete search history.

(56) References Cited

U.S. PATENT DOCUMENTS 4,289,302 A 9/1981 Mongomery
4,809,955 A 3/1989 Veilleux
5,474,279 A * 12/1995 Parisien ..... E04H 17/1488 256/69
5,702,090 A 12/1997 Edgman
5,713,171 A 2/1998 Andres
5,938,184 A * 8/1999 DeSouza ..... E04H 17/1417 256/65.06
5,988,599 A 11/1999 Forbis
6,345,809 B1 * 2/2002 Bebendorf ..... E04H 17/16 256/65.02
6,398,193 B1 * 6/2002 DeSouza ..... E04H 17/1488 256/65.06
6,637,728 B2 10/2003 Pettit et al.
7,267,324 B2 9/2007 Young
7,396,002 B1 7/2008 Gibbs
8,132,791 B2 3/2012 Stucker
8,511,648 B2 * 8/2013 McCarthy ..... E04H 17/16 256/65.01
8,919,742 B2 * 12/2014 Williams, Sr. ..... E04H 17/1447 256/65.13
9,506,270 B2 11/2016 Knudsen
11,286,687 B2 * 3/2022 Springborn ..... E04H 17/1417
2004/0140461 A1 7/2004 Lappen
2005/0199864 A1 9/2005 Gibbs et al.
2006/0113517 A1 * 6/2006 Colantonio ..... E04H 17/168 256/24
2006/0255325 A1 11/2006 Lo et al.
2006/0273502 A1 12/2006 Sade et al.
2008/0179580 A1 * 7/2008 McGinness ..... E04H 17/16 256/59
2009/0078923 A1 3/2009 McGinness
2009/0152523 A1 * 6/2009 Erwin ..... E04H 17/1602 256/24
2010/0200825 A1 * 8/2010 Hill ..... E04H 17/16 256/24
2011/0024060 A1 * 2/2011 Brownbill ..... E04F 11/1842 160/188
2011/0233496 A1 9/2011 Caruso
2015/0041743 A1 2/2015 Richison et al.
2021/0032899 A1 * 2/2021 Taylor ..... E04H 17/1426

FOREIGN PATENT DOCUMENTS

DE 29704112 U1 * 6/1997 ..... E04F 11/1842
DE 102007023501 A1 * 11/2008 ..... E04H 17/1421
DE 202013105162 U1 * 2/2014 ..... E04F 11/1844

* cited by examiner

FENCING ASSEMBLY

CROSS-REFERENCE TO RELATED APPLICATIONS

This application is a continuation of and claims priority to U.S. application Ser. No. 16/216,678, filed Dec. 11, 2018, now U.S. Pat. No. 11,286,687, which claims priority to U.S. Provisional Application Ser. No. 62/598,307, filed Dec. 13, 2017, all of which are incorporated herein by reference in their entirety.

TECHNICAL FIELD

This instant disclosure relates generally to a fencing assembly.

BACKGROUND

Conventional fencing systems can be bulky and difficult to assemble. Particularly, gates associated with conventional fencing systems can be limited in their design, can be difficult to assemble, and may not be sufficiently sturdy in their construction. For example, many gate designs can have multiple pieces that need to be assembled at the installation site, adding to installation costs and slowing the speed of installation. Furthermore, multiple discrete components can form the gate, which need to be assembled in the field, oftentimes by screws, bolts, etc. The design of the gates, combined with the assembly methods can oftentimes lead to a gate that is not sufficiently sturdy and further has an appearance that is cluttered by multiple fasteners holding the gate together. A design that may eliminate and/or simplify one or more of the above activities from an assembly process may be desirable.

SUMMARY

Various embodiments of the present disclosure can include a fencing assembly. In some embodiments, the fencing assembly can include a top cross-member including a first channel. In some embodiments, the fencing assembly can include a bottom cross-member including a second channel that opposes the first channel. In some embodiments, the fencing assembly can include a first vertical support member, wherein the first vertical support member is connected to a first end of the top cross-member and a first end of the bottom cross-member. In some embodiments, the fencing assembly can include a second vertical support member, wherein the second vertical support member is connected to a second end of the top cross-member and a second end of the bottom cross-member. In some embodiments, the fencing assembly can include a planar barrier, wherein the planar barrier is inserted into the first channel and the second channel and is confined on a first and second side of the planar barrier by the first vertical support member and the second vertical support member.

Various embodiments of the present disclosure can include a fencing assembly. In some embodiments, the fencing assembly can include a top cross-member including a first channel. In some embodiments, the fencing assembly can include a bottom cross-member including a second channel. In some embodiments, the fencing assembly can include a middle cross-member that includes a third and fourth channel, wherein the third channel opposes the first channel and the fourth channel opposes the second channel. In some embodiments, the fencing assembly can include a first vertical support member, wherein the first vertical support member is connected to a first end of the top cross-member, a first end of the middle cross-member and a first end of the bottom cross-member. In some embodiments, the fencing assembly can include a second vertical support member, wherein the second vertical support member is connected to a second end of the top cross-member, a second end of the middle cross-member, and a second end of the bottom cross-member. In some embodiments, the fencing assembly can include a first planar barrier inserted into the first channel and the third channel and confined on a first and second side by the first vertical support member and the second vertical support member. In some embodiments, the fencing assembly can include a second planar barrier inserted into the fourth channel and the second channel and confined on a first and second side by the first vertical support member and the second vertical support member.

Various embodiments of the present disclosure can include a method for assembling a gate. In some embodiments, the method can include providing a top cross-member including a first channel. In some embodiments, the method can include providing a bottom cross-member including a second channel. In some embodiments, the method can include providing a first vertical support member, the first vertical support defining a thru hole through a top of the first vertical support member. In some embodiments, the method can include providing a second vertical support member, the second vertical support defining a blind hole in a top of the first vertical support member. In some embodiments, the method can include providing a planar barrier that includes a bottom barrier end and a top barrier end. In some embodiments, the method can include connecting a first and second end of the bottom cross-member to a bottom of the first and second vertical support member, respectively. In some embodiments, the method can include inserting the bottom barrier end of the planar barrier into the first channel. In some embodiments, the method can include inserting a first end of the top cross-member through the thru hole defined in the top of the first vertical support member and into the blind hole of the second vertical support member, such that the top barrier end is engaged by the first channel of the top cross-member.

BRIEF DESCRIPTION OF THE DRAWINGS

The accompanying drawings, which are included to provide a further understanding are incorporated in and constitute a part of this specification, illustrate preferred embodiments and, together with the detailed description, serve to explain the principles of embodiments of the disclosure. In the drawings.

DETAILED DESCRIPTION

Reference will now be made in detail to embodiments of the present disclosure, examples of which are described herein and illustrated in the accompanying drawings. While the disclosure will be described in conjunction with embodiments, it will be understood that they are not intended to limit the disclosure to these embodiments. On the contrary, the disclosure is intended to cover alternatives, modifications and equivalents, which may be included within the spirit and scope of the disclosure.

Figure 1A:
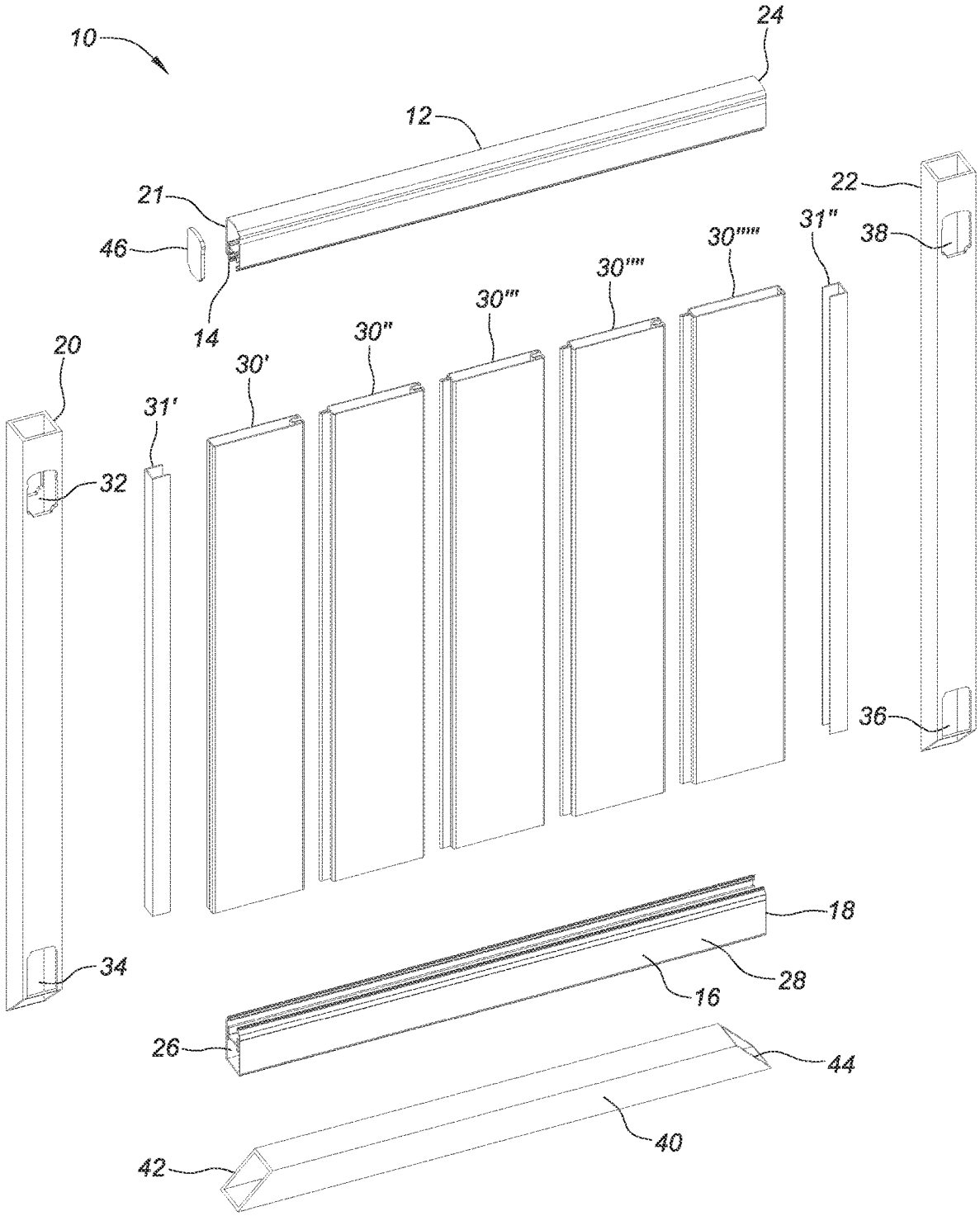
FIGS. 1A and 1B are exploded views generally illustrating portions of embodiments of a fencing assembly, in accordance with embodiments of the present disclosure.
Figure 1B:
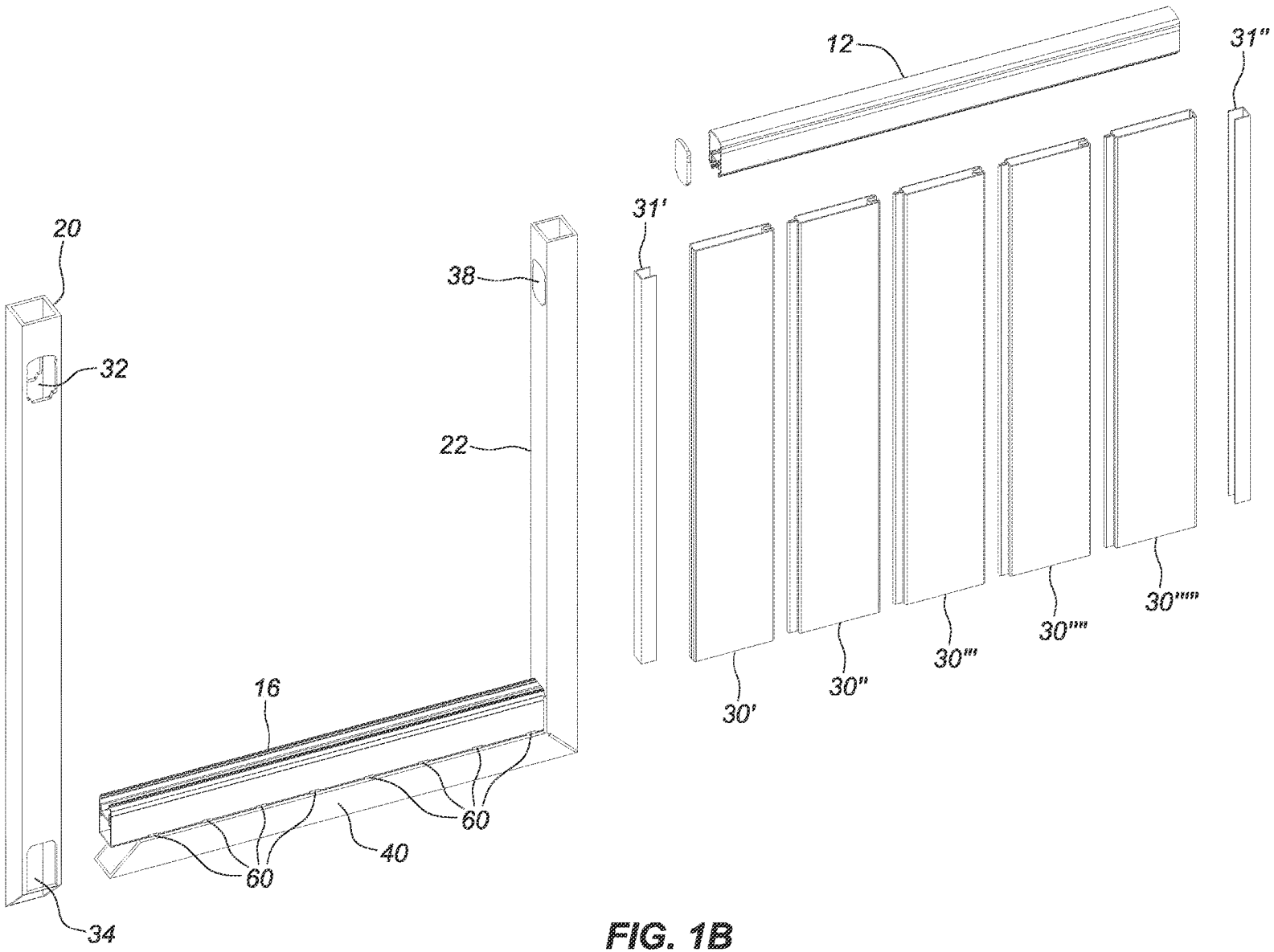

FIGS. 1A and 1B are exploded views generally illustrating portions of embodiments of a fencing assembly, in accordance with embodiments of the present disclosure. FIG. 1A depicts a fencing assembly 10. The fencing assembly 10 can in some embodiments be a gate assembly. For example, the fencing assembly 10 can include hinges on a first side of the fencing assembly (e.g., along first or second vertical support member 20, 22, further discussed herein), configured to allow the fencing assembly 10 to act as a gate assembly. For instance, the fencing assembly 10 can pivot on the hinges and be swung open or shut. In some embodiments, the fencing assembly 10 can include a top cross-member 12 including a first channel 14. The fencing assembly 10 can further include a bottom cross-member 16 including a second channel 18. In some embodiments, the top cross-member 12 and the bottom cross-member 16 can be assembled such that the first channel 14 and the second channel 18 oppose one another, as further discussed herein.

In some embodiments, the fencing assembly 10 can include a first vertical support member 20. The first vertical support member 20 can be connected to a first top cross-member end 21 of the top cross-member 12 and a first bottom cross-member end 26 of the bottom cross-member 16. In some embodiments, the fencing assembly 10 can include a second vertical support member 22, which can be connected to a second top cross-member end 24 of the top cross-member 12 and a second bottom cross-member end 28 of the bottom cross-member 16.

The connection of the top cross-member 12, the bottom cross-member 16, first vertical support member 20, and second vertical support member 22 can form a frame into which a planar barrier material 30 can be inserted, which is depicted as sections of vinyl paneling 30', 30", 30'", 30"", 30'"", collectively referred to herein as planar barrier material 30. However, the planar barrier material 30 can be formed from other types of material, such as glass, metal, wood, plastic, etc. In some embodiments, a pair of fillers 31', 31" can be disposed on either side of the planar barrier material 30.

In some embodiments, the fencing assembly 10 can include a bottom support member 40. The bottom support member 40 can be connected to a bottom of the bottom cross-member 16. In some embodiments, a first side 42 (e.g., end) of the bottom support member 40 can be connected to the first vertical support member 20 and a second side 44 (e.g., end) of the bottom support member 40 can be connected to the second vertical support member 22.

As depicted in FIG. 1A, members that form the fencing assembly (i.e., the first vertical support member 20, the second vertical support member 22, the top cross-member 12, the bottom cross-member 16, and/or the bottom support member 40) can be formed from tubular stock in some embodiments. For example, the members can be hollow in some embodiments. In an example, hollow members can result in a lighter weight fencing assembly and can further result in a lesser cost of materials. However, one or more of the members can be formed from a solid stock material in some embodiments. In some embodiments, wherein an exposed end of the tubular stock exists, for example, the first top cross-member end 21 of the top cross-member 12, an end plate 46 can be connected to the first top cross-member end 21 of the top cross-member 12. In an example, the end plate 46 can give the appearance that the tubular stock is a solid piece of material. Furthermore, the end plate 46 can prevent water and/or debris from entering a lumen formed by the tubular stock that forms the top cross-member 12.

In some embodiments, the first vertical support member 20 can define a thru hole 32 at a top of the first vertical support member 20 and can form a blind hole 34 at a bottom of the first vertical support member 20. The second vertical support member 22 can form a blind hole 38 at the top of the second vertical support member 22 and a blind hole 36 at the bottom of the second vertical support member 22. In some embodiments, the bottom cross-member 16 can be configured to be inserted into the blind holes 34, 36 formed in the bottoms of the first and second vertical support members 20, 22, as further depicted in FIGS. 1B and 1C. Furthermore, the bottom support member 40 can be connected to the bottom cross-member 16. For instance, a bottom surface of the bottom cross-member 16 can be connected to a top surface of the bottom support member 40, as depicted in FIGS. 1B and 1C.

Figure 1C:
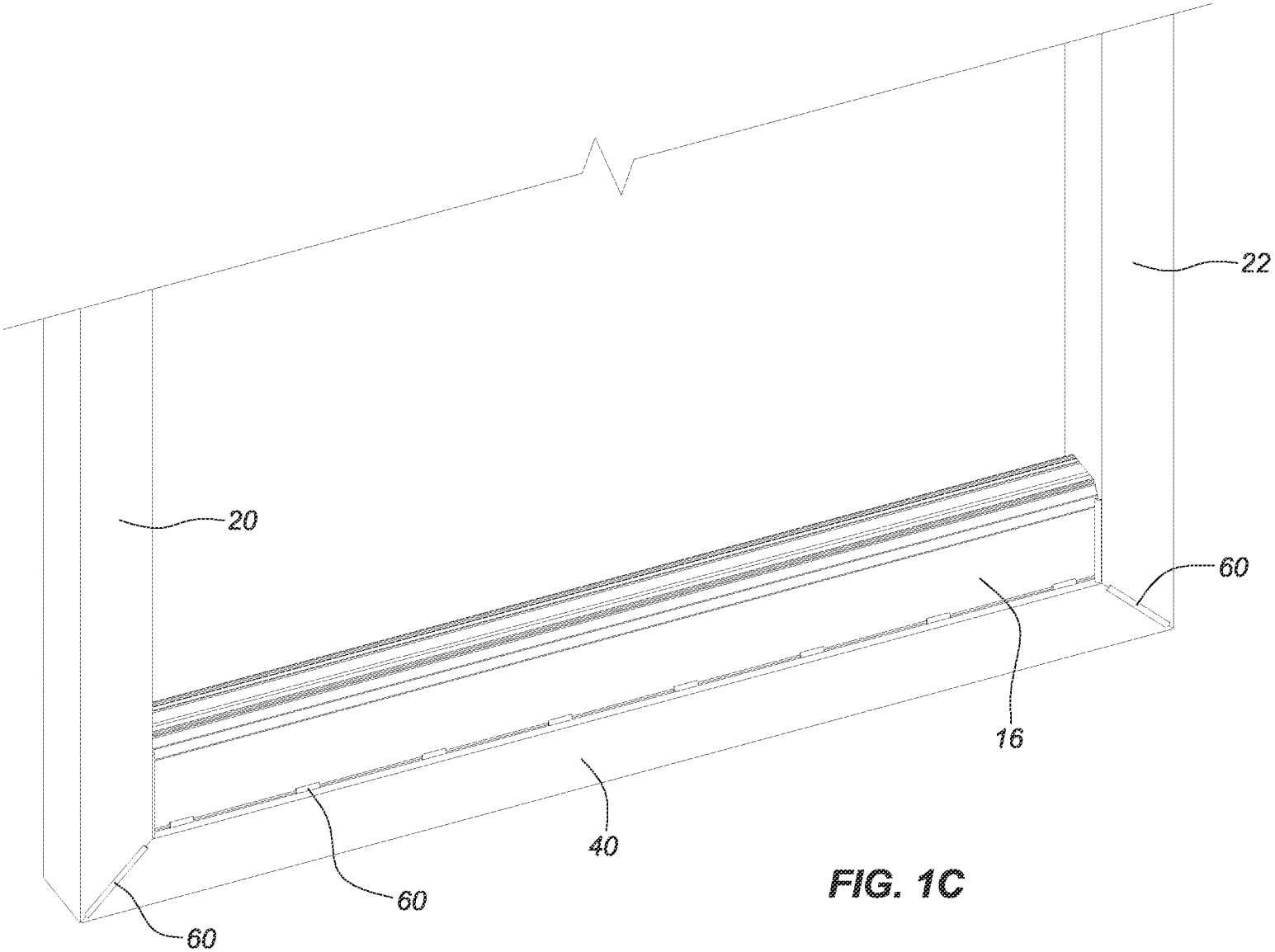
FIGS. 1C and 1D are isometric views that illustrate connection of first and second vertical support members with a bottom cross-member and bottom support member, in accordance with embodiments of the present disclosure.

FIGS. 1B and 1C depict the connection of the first vertical support member 20 (FIG. 2C), the second vertical support member 22, the bottom cross-member 16, and the bottom support member 40. In some embodiments, the bottom cross-member 16 can be inserted into the blind holes 34, 36 (FIG. 1A) formed in the bottom portions of the first vertical support member 20 and the second vertical support member 22. In an example, the first bottom cross-member end 26 of the bottom cross-member 16 can be inserted into the first blind hole 34 of the first vertical support member 20 and the second bottom cross-member end 28 of the bottom cross-member 16 can be inserted into the second blind hole 36 of the second vertical support member 22. In some embodiments, the first blind hole 34 and the second blind hole 36 can be sized such that the first bottom cross-member end 26 and the second bottom cross-member end 28 fit snugly into the blind holes 34, 36. As depicted, upon insertion of the first and second bottom cross-member ends 26, 28 into the blind holes 34, 36, a weld 60 can be formed around an intersection of the bottom cross-member 16 and each of the first and second vertical support members 20, 22, as depicted in FIGS. 1B and 1C.

In some embodiments, the bottom support member 40 can be welded to the bottom cross-member 16 via a series of welds 60, as depicted, and the first vertical support member 20 and the second vertical support member 22 can be connected to one another via welds 60. In some embodiments, the first end of the bottom support member 40 and the second end of the bottom support member 40 can be cut at forty-five degree angles and the bottom of the first vertical support member 20 and the second vertical support member 22 can be cut at forty-five degree angles such that upon connection of the first and second vertical support members 20, 22 with the bottom support member 40, a ninety degree angle is formed between the first vertical support member 20 and the bottom support member 40 and the second vertical support member 22 and the bottom support member 40.

Figure 1D:
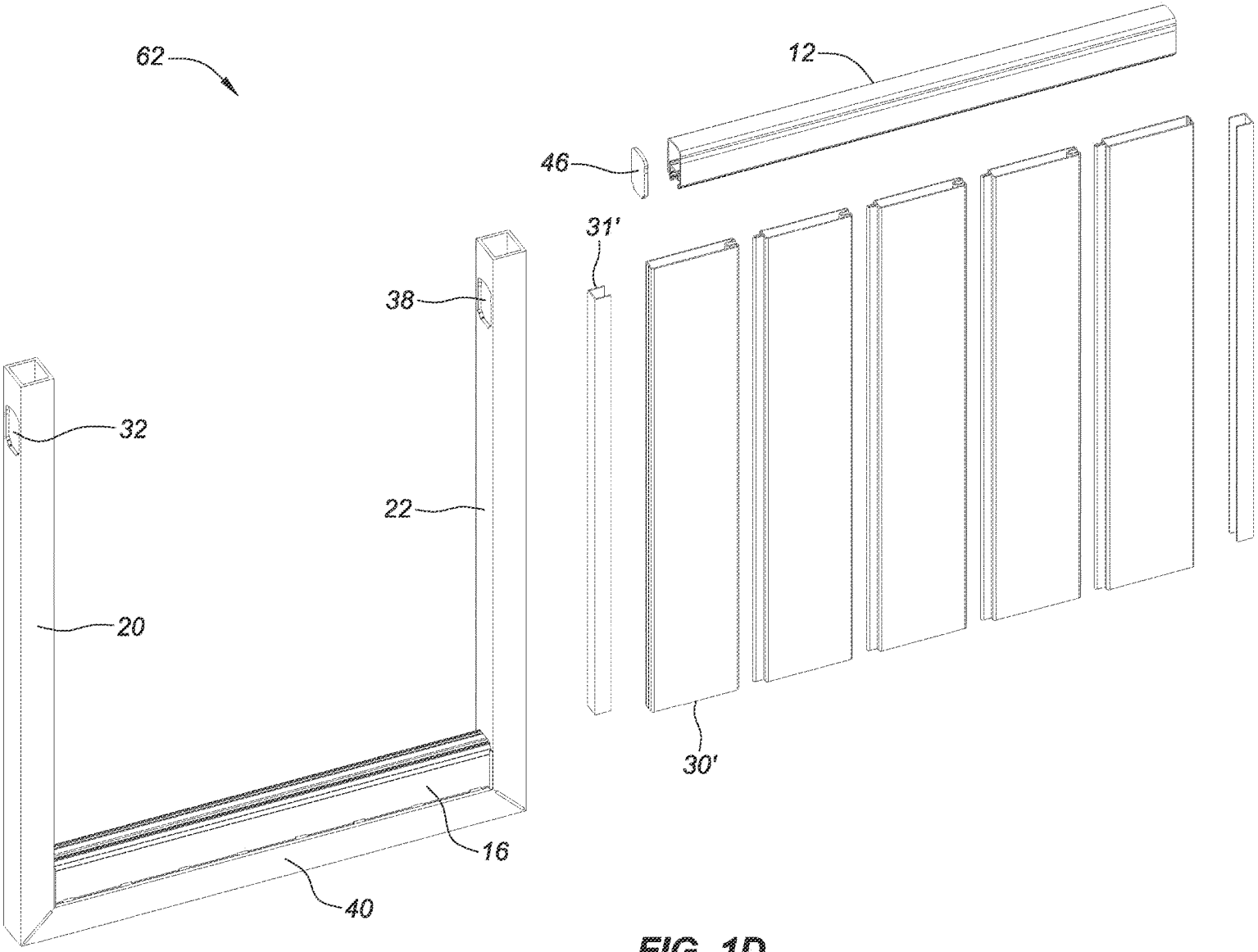

FIGS. 1C and 1D are isometric views that further illustrate connection of first and second vertical support members 20, 22 with the bottom cross-member 16 and bottom support member 40, in accordance with embodiments of the present disclosure. Upon connection of the first and second vertical support members 20, 22 with the bottom cross-member 16 and bottom support member 40, a fencing assembly frame 62 can be formed, into which the planar barrier material 30 and the fillers 31 can be inserted. In some embodiments, the filler 31 can be formed as a u-channel and the sides of the planar barrier material can be inserted into a channel formed by the u-channel. In some embodiments, the fillers 31 can fill a space between the edge of the planar barrier material 30 and the first and second vertical support members (e.g., frames) 20, 22 and/or can provide a finished look to a cut edge of the planar barrier material 30, which has been cut to size to fit between the first and second vertical support members 20, 22.

Figure 1E:
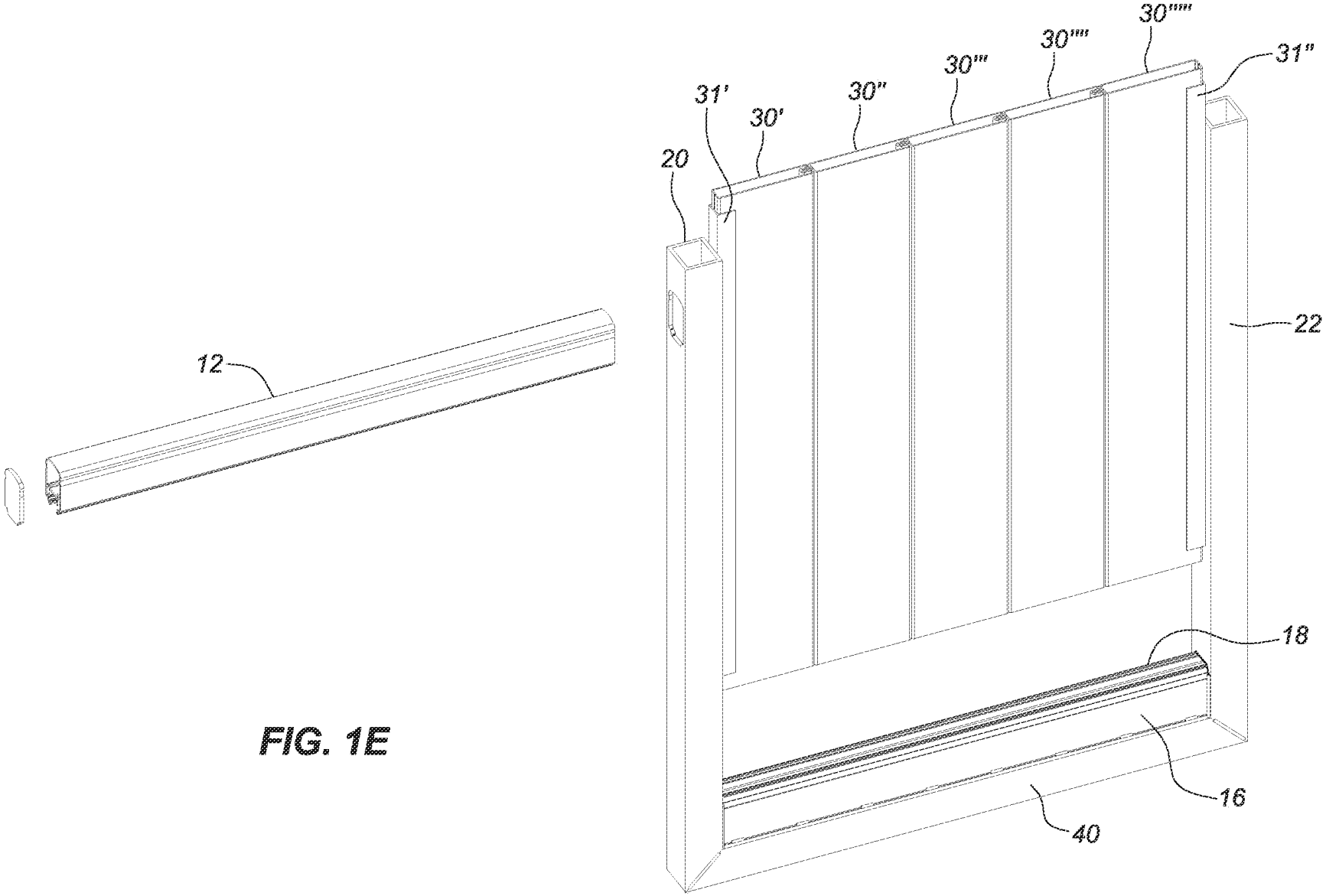
FIGS. 1E and 1F are isometric views that illustrate insertion of a planar barrier into a second channel formed on the bottom cross-member, in accordance with embodiments of the present disclosure.
Figure 1F:
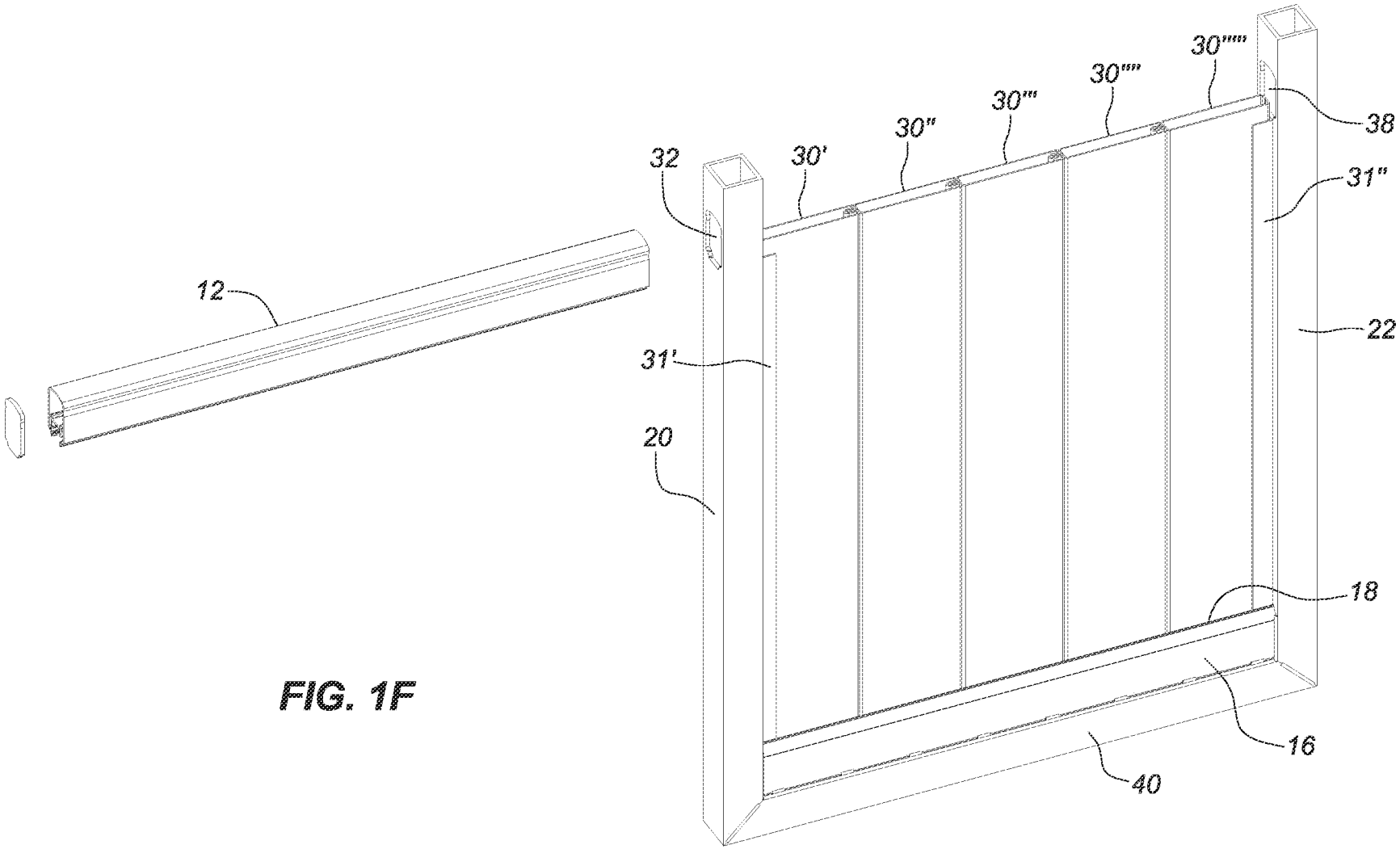

FIGS. 1E and 1F are isometric views that illustrate insertion of a planar barrier 30 into the second channel 18 formed on the bottom cross-member 16, in accordance with embodiments of the present disclosure. As depicted, the planar barrier material 30 can have tongue and groove features, enabling each section of planar barrier material 30 to interlock with another section of planar barrier material 30. However, this is not required in some embodiments. The sections of planar barrier material 30', 30", 30''', 30'''', 30''''' have been assembled such that they are located side by side. The fillers 31', 31" have also been positioned on either side of the assembled sections of planar barrier material 30', 30", 30''', 30'''', 30'''''. As depicted, the sections of planar barrier material 30 are slid between the first vertical support member 20 and second vertical support member 22 and into the second channel 18, as further depicted in FIG. 1F.

As depicted in FIG. 1F, upon insertion of the planar barrier 30 into the second channel 18, a top of the planar barrier 30 can extend to a height of the thru hole 32 formed in the first vertical support member and to a height of the blind hole 38 formed in the top of the second vertical support member 22. In an example, the planar barrier material 30 can cover a portion of each one of the thru hole 32 and blind hole 38. Accordingly, a solid piece of material that is of a size and shape to fit through the holes 32, 38 cannot be inserted through the holes 32, 38, because the planar barrier material 30 obstructs a path between the holes 32, 38. Accordingly, the top cross-member 12 can include a channel 14, as further discussed herein.

Figure 1G:
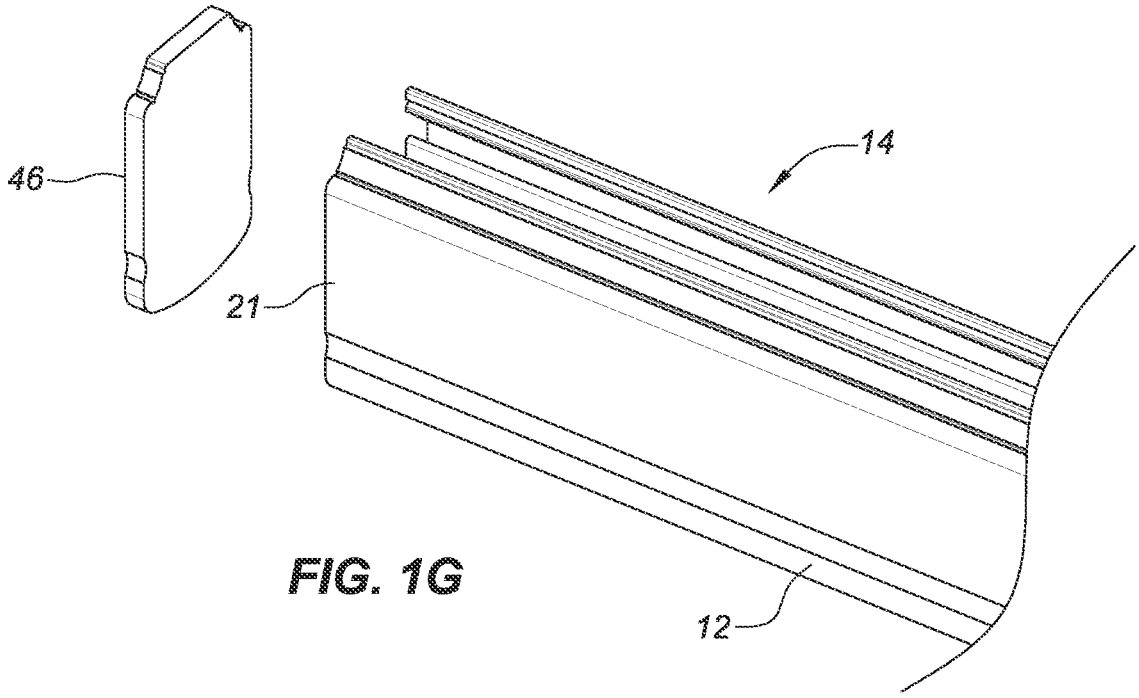
FIGS. 1G and 1H are isometric views that illustrate connection of an end plate to a first end of a top cross-member, in accordance with embodiments of the present disclosure.
Figure 1H:
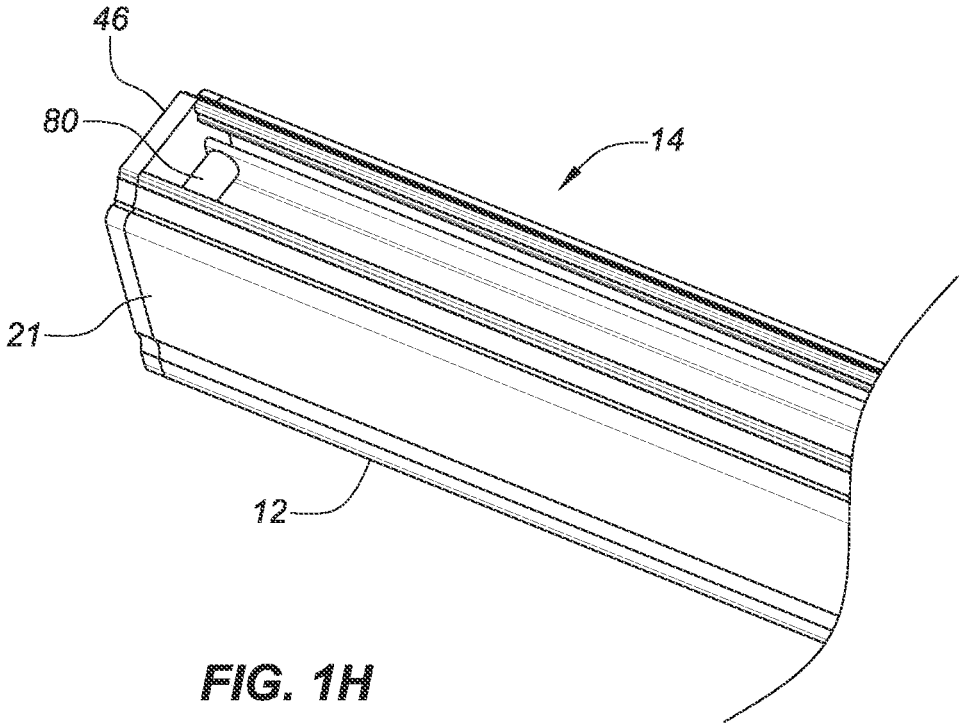
Figure 1I:
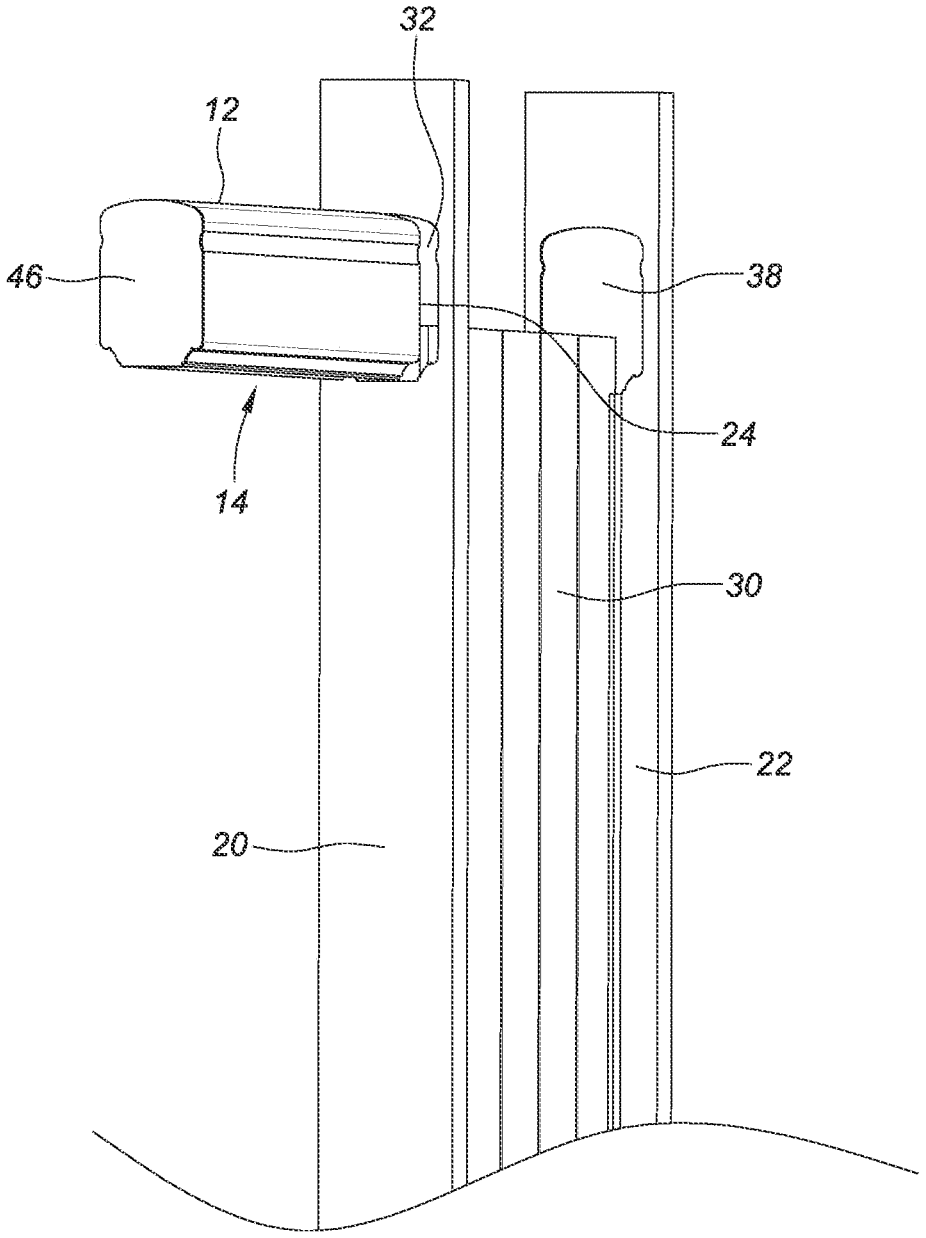
FIGS. 1I-1L are isometric views that illustrate connection of the top cross-member with the first vertical support member, the second vertical support member, and the planar barrier, in accordance with embodiments of the present disclosure.

FIGS. 1G and 1H are isometric views that illustrate connection of the end plate 46 to the first end of the top cross-member 12, in accordance with embodiments of the present disclosure. FIGS. 1G and 1H further depict the channel 14 defined by a bottom surface of the top cross-member 12, a configuration of which is further discussed in relation to FIGS. 3A to 3C. In an example, the top portion of the planar barrier material 30 can be disposed in the channel 14, as further discussed herein. FIGS. 1G and 1H further depict the connection of the end plate 46 to first top cross-member end 21. In some embodiments, the end plate 46 can have a same cross-sectional profile as the top cross-member, with the exception that the end plate 46 further includes material where the channel 14 is defined in the first top cross-member 12. In some embodiments, as depicted in FIG. 1H, the end plate 46 can be connected to the first top cross-member end 21. In some embodiments, the end plate 46 can be connected to the first top cross-member end 21 via one or more welds 80. Upon connection of the end plate 46 to the first top cross-member end 21, the end plate can give the appearance that the first top cross-member 12 is a solid piece of material and can also cover a lumen formed by the tubular piece of material and can cover the channel 14, an importance of which is further discussed herein in relation to FIGS. 1I to 1L, for example.

FIGS. 1I-1L are isometric views that illustrate connection of the top cross-member 12 with the first vertical support member 20, the second vertical support member 22, and the planar barrier 30, in accordance with embodiments of the present disclosure. In some embodiments, an end plate 46 can only be connected to the first top cross-member end 21 (FIG. 1H), such that the channel 14 is exposed on the second top cross-member end 24. This can enable the second top cross-member end 24 to be inserted through the through hole and through the space separating the first vertical support member 20 and the second vertical support member 22 and into the blind hole 38 defined in the second vertical support member 22. In an example, the channel 14 can pass over the top portion of the planar barrier 30, locking the planar barrier 30 into place as the second top cross-member end 24 is inserted into the blind hole 38.

Figure 1J:
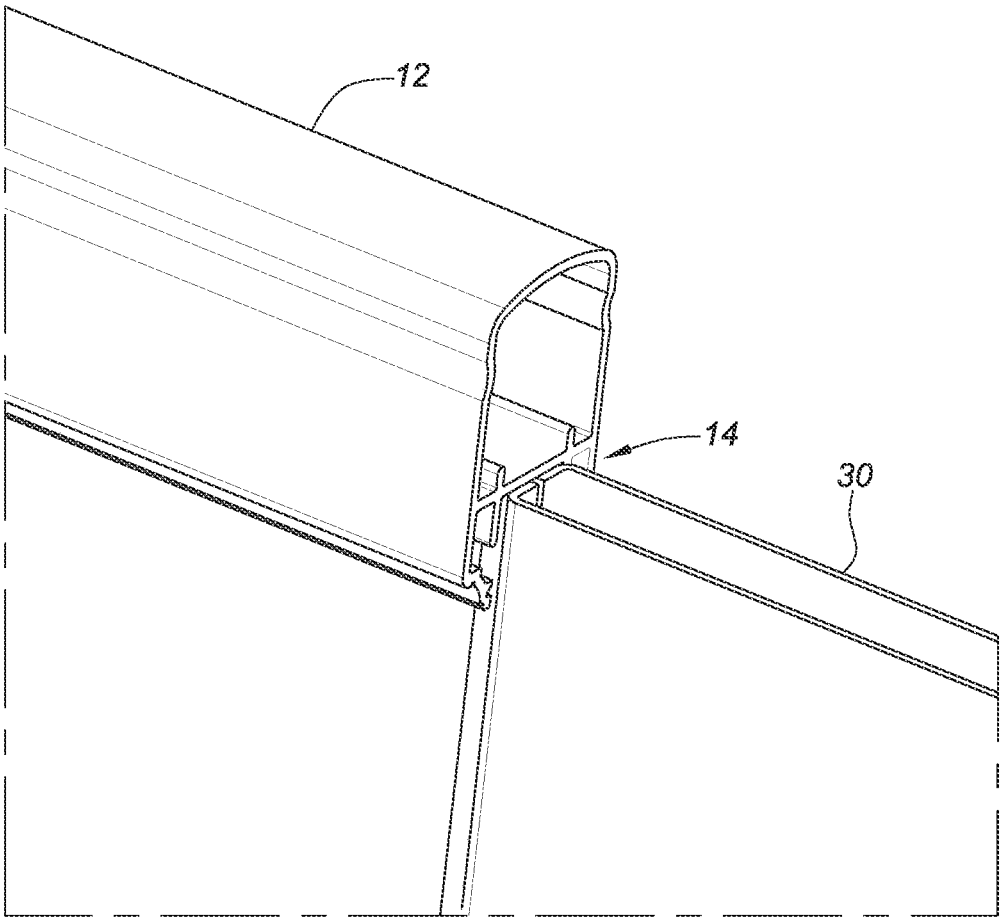
Figure 1K:
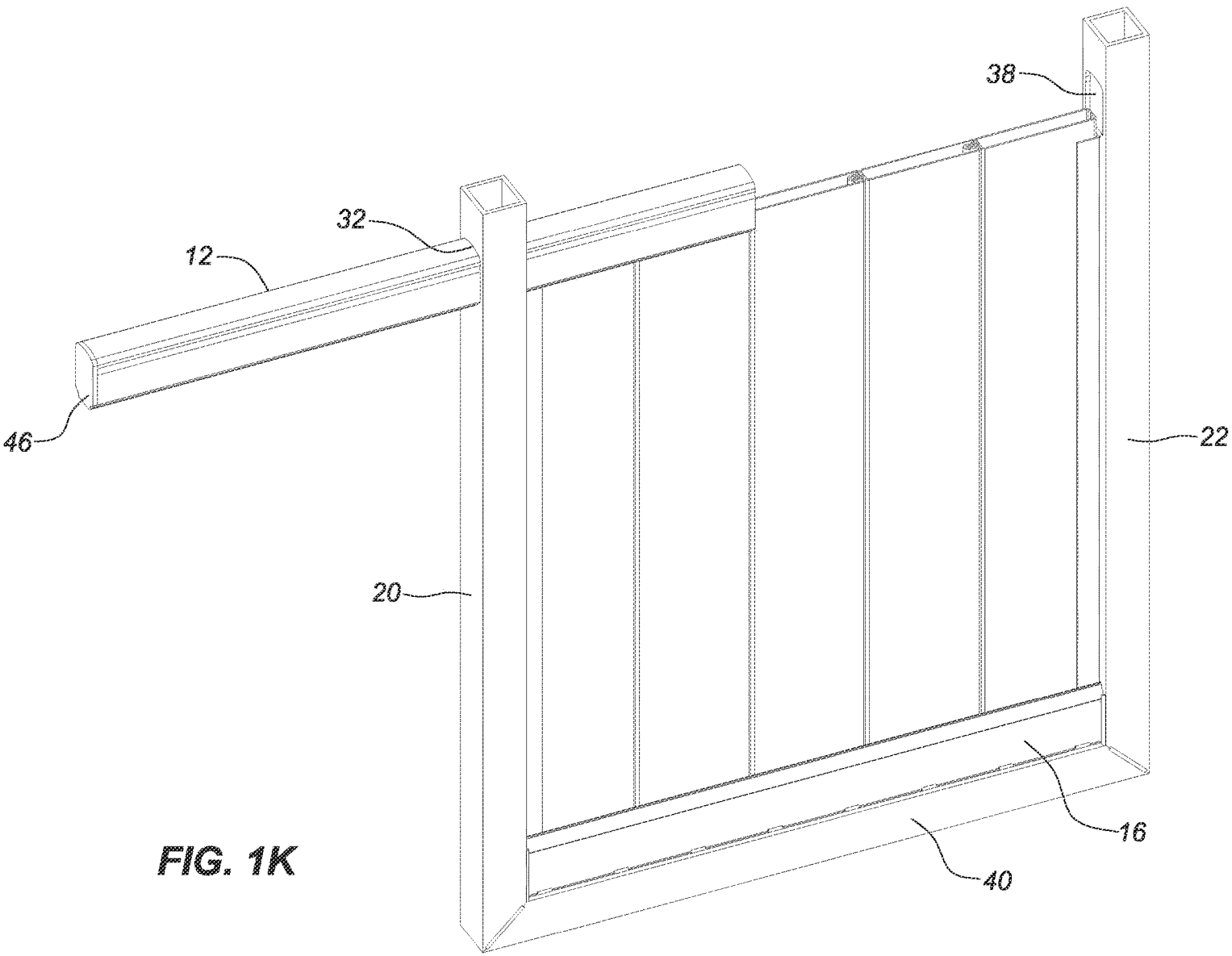
Figure 1L:
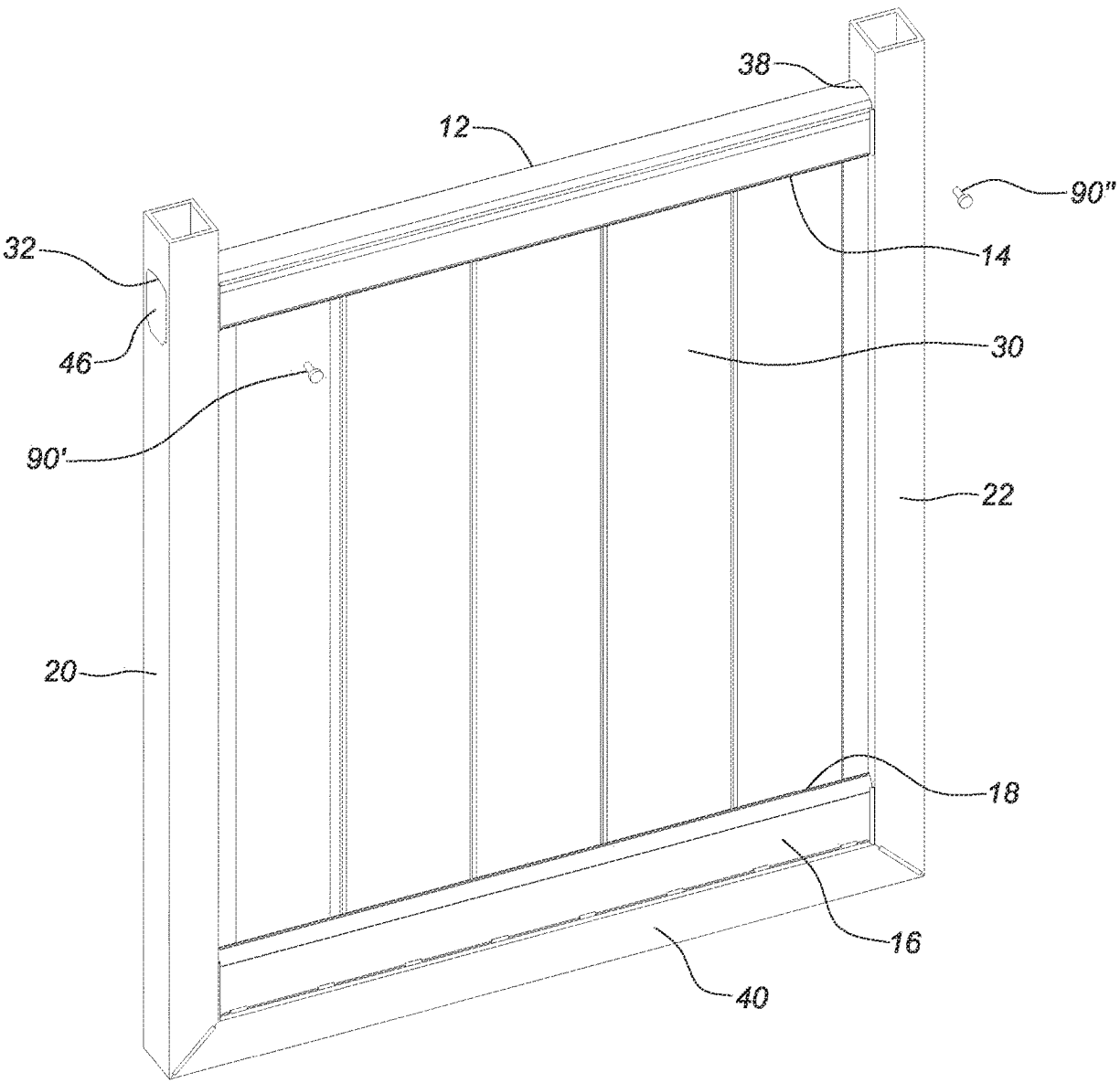

FIG. 1J illustrates an isometric close-up view of the planar barrier 30, which is illustrated as being hollow in FIG. 1J, passing through the channel 14 of the top cross-member 12. FIG. 1K further illustrates the top cross-member 12 partially inserted through the thru hole 32 and across a top of the planar barrier 30. FIG. 1L depicts the top cross-member as fully inserted into the blind hole 38 and across a top of the planar barrier 30, thus securing the planar barrier 30 in place. As further depicted, upon full insertion of the top cross-member 12 into the blind hole, the end plate 46 can be flush or relatively flush with an outside wall of the first vertical support member 20, thus providing a seamless fencing assembly. In some embodiments, a pair of fasteners 90', 90" can be driven through the first vertical support member 20 and the second vertical support member 22 at an intersection of the top cross-member 12 with each of the first vertical support member 20 and second vertical support member 22. In some embodiments, the fasteners 90', 90" can be screws, such as sheet metal screws. Upon full assembly of fencing assembly, the planar barrier 30 can be locked into place via the first channel 14 and the second channel 18, which oppose one another.

Figure 2A:
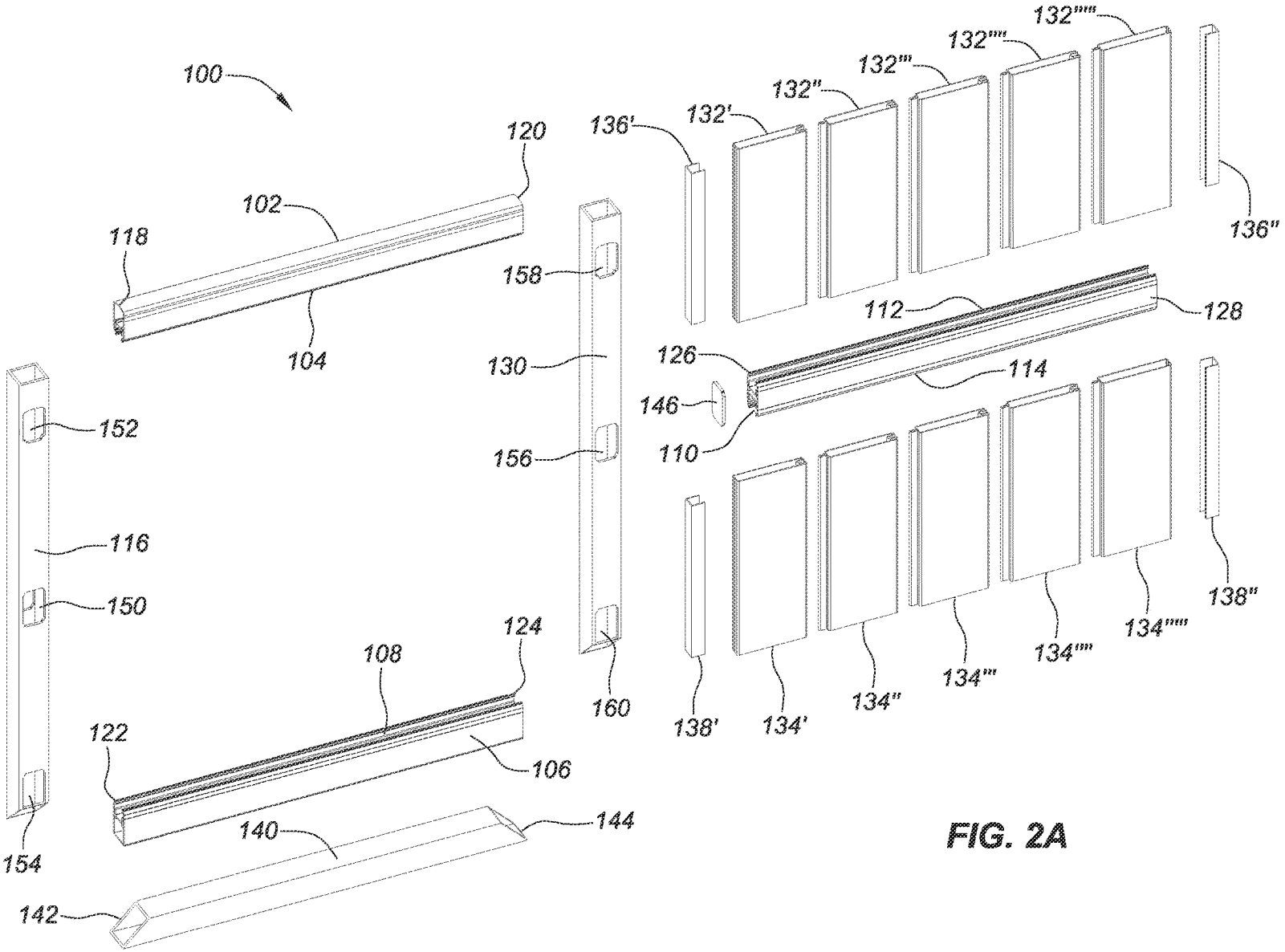
FIGS. 2A-2D are exploded views illustrating connection of a top cross-member, bottom cross-member, first vertical support member, second vertical support member, and bottom support member and further illustrating a middle cross-member and first and second planar barriers, in accordance with embodiments of the present disclosure.
Figure 2B:
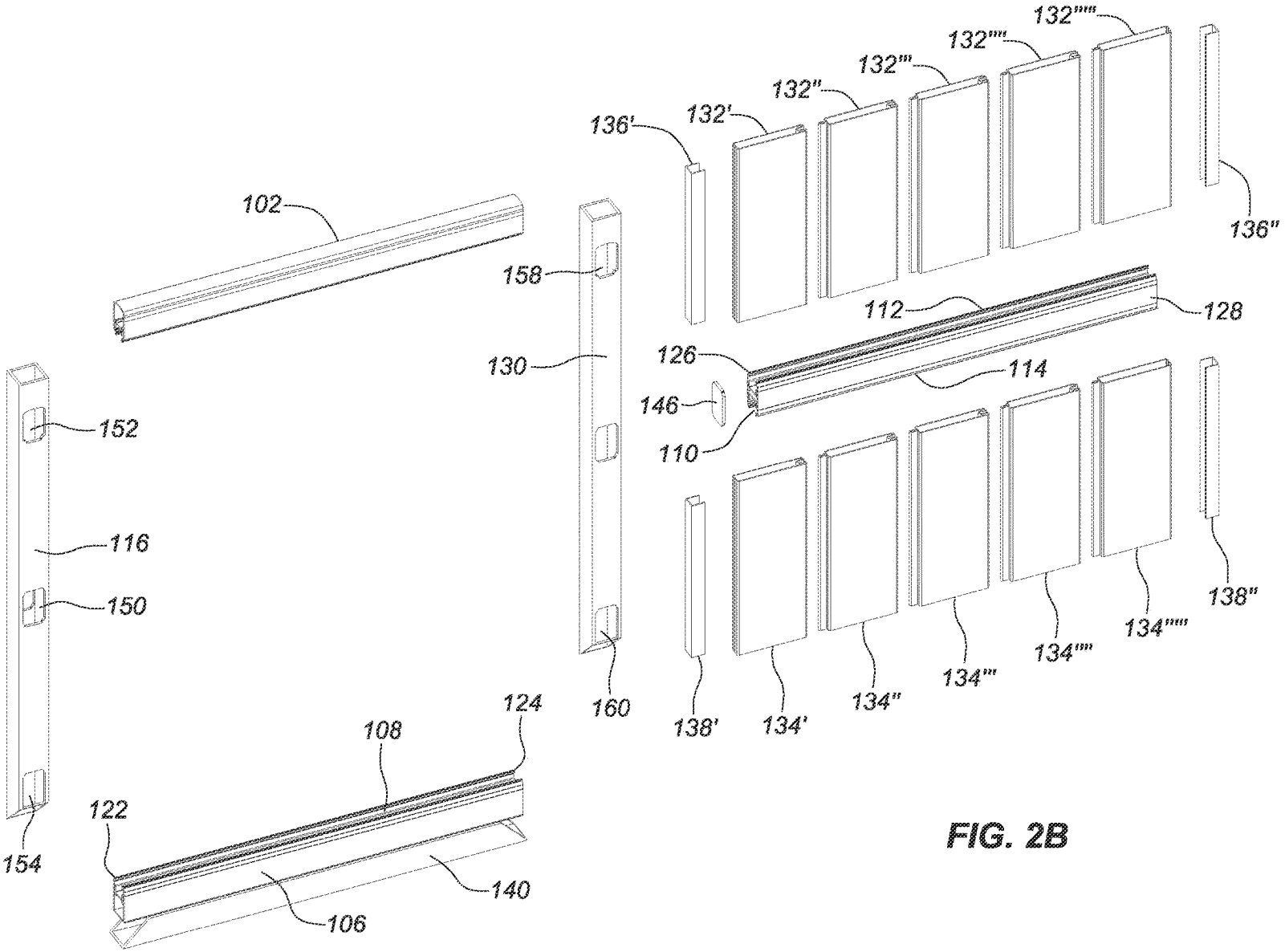

FIGS. 2A and 2B are exploded views illustrating connection of a top cross-member, bottom cross-member, first vertical support member, second vertical support member, and bottom support member and further illustrating a middle cross-member and first and second planar barriers, in accordance with embodiments of the present disclosure. FIG. 2A depicts a fencing assembly 100. The fencing assembly 100 can in some embodiments be a gate assembly.

For example, the fencing assembly 100 can include hinges on a first side of the fencing assembly, configured to allow the fencing assembly 100 to act as a gate assembly. For instance, the fencing 100 assembly can pivot on the hinges and be swung open or shut. The fencing assembly 100 can include a top cross-member 102 including a first channel 104. The fencing assembly 100 can further include a bottom cross-member 106 including a second channel 108. The fencing assembly 100 can further include a middle cross-member 110 that includes a third channel 112 and fourth channel 114. In some embodiments, the top cross-member 102, middle cross-member 110, and the bottom cross-member 106 can be assembled such that the first channel 104 opposes the third channel 112 and the second channel 108 opposes the fourth channel, as further discussed herein.

In some embodiments, the fencing assembly 100 can include a first vertical support member 116. The first vertical support member 116 can be connected to a first top cross-member end 118 of the top cross-member 102 and a first bottom cross-member end 122 of the bottom cross-member 106, as well as a first middle cross-member end 126 of the middle cross-member 110. In some embodiments, the fencing assembly 100 can include a second vertical support member 130 and the second vertical support member 130 can be connected to a second top cross-member end 120 of the top cross-member 102 and a second bottom cross-member end 124 of the bottom cross-member 106, as well as a second middle cross-member end 128 of the middle cross-member 110. The connection of the top cross-member 102, the bottom cross-member 106, middle cross-member 110, first vertical support member 116, and second vertical support member 130 can form a frame into which a first row of planar barrier material 132 can be inserted, which is depicted as sections of vinyl paneling planar barrier material 132', 132", 132''', 132'''', 132''''' (e.g., vinyl paneling), collectively referred to herein as planar barrier material 132, and a second row of planar barrier material 134 can be inserted, which is depicted as sections of planar barrier material 134', 134", 134''', 134'''', 134''''' (e.g., vinyl paneling), collectively referred to herein as planar barrier material 134. However, the planar barrier material 132, 134 can be formed from other types of material, such as glass, metal, wood, plastic, etc. In some embodiments, a pair of top fillers 136', 136" and a pair of bottom fillers 138', 138" can be disposed on either side of the planar barrier material 132, 134.

In some embodiments, the fencing assembly 100 can include a bottom support member 140. The bottom support member 140 can be connected to a bottom of the bottom cross-member 106. In some embodiments, a first side 142 (e.g., end) of the bottom support member 140 can be connected to the first vertical support member 116 and a second side 144 (e.g., end) of the bottom support member 140 can be connected to the second vertical support member 130.

As depicted in FIG. 2A, members that form the fencing assembly (i.e., the first vertical support member 116, the second vertical support member 130, the top cross-member 102, the bottom cross-member 106, middle cross-member 110, and/or the bottom support member 40) can be formed from tubular stock in some embodiments. For example, the members can be hollow in some embodiments. In an example, hollow members can result in a lighter weight fencing assembly and can further result in a lower cost of materials. However, one or more of the members can be formed from a solid stock material in some embodiments. In some embodiments, wherein an exposed end of the tubular stock exists, for example, the middle cross-member end 126 of the middle cross-member 110, an end plate 146 can be connected to the first middle cross-member end 126 of the middle cross-member 110. In an example, the end plate 146 can give the appearance that the tubular stock is a solid piece of material. Furthermore, the end plate 146 can prevent water and/or debris from entering a lumen formed by the tubular stock that forms the middle cross-member 110.

In some embodiments, the first vertical support member 116 can define a thru hole 150 in a middle of the first vertical support member 116 and can form blind holes 152, 154 at a top and bottom of the first vertical support member 116. The second vertical support member 130 can form blind holes 158, 156, 160 at the top, middle and bottom of the second vertical support member 130 that correspond to the holes 152, 150, 154 in the first vertical support member 116. In some embodiments, the bottom cross-member 106 can be configured to be inserted into the blind holes 154, 160 formed in the bottoms of the first and second vertical support members 116, 130, as further depicted in FIGS. 2C and 2D. Furthermore, the bottom support member 140 can be connected to the bottom cross-member 106. For instance, a bottom surface of the bottom cross-member 106 can be connected to a top surface of the bottom support member 140, as depicted in FIGS. 2B and 2C.

Figure 2C:
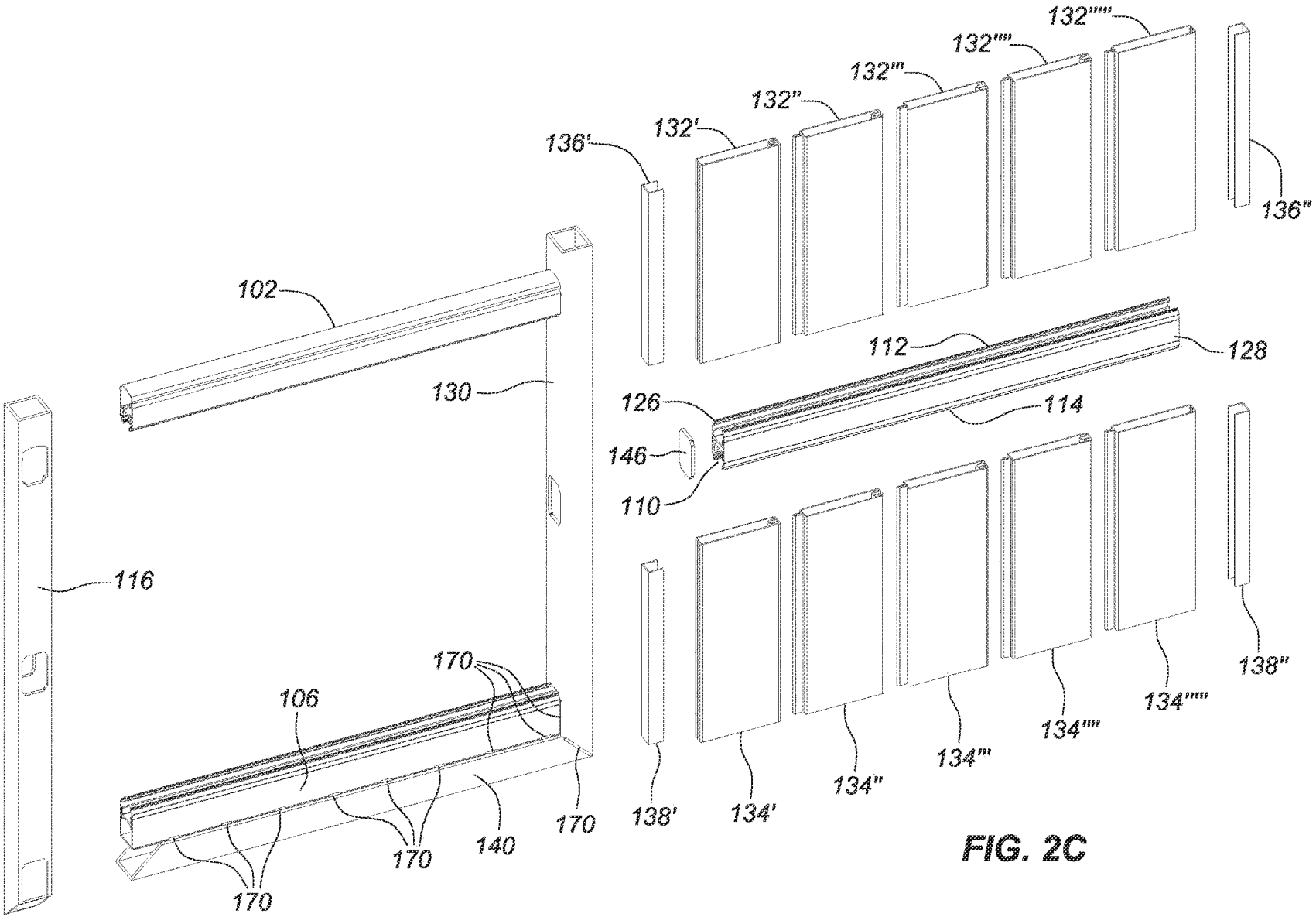
Figure 2D:
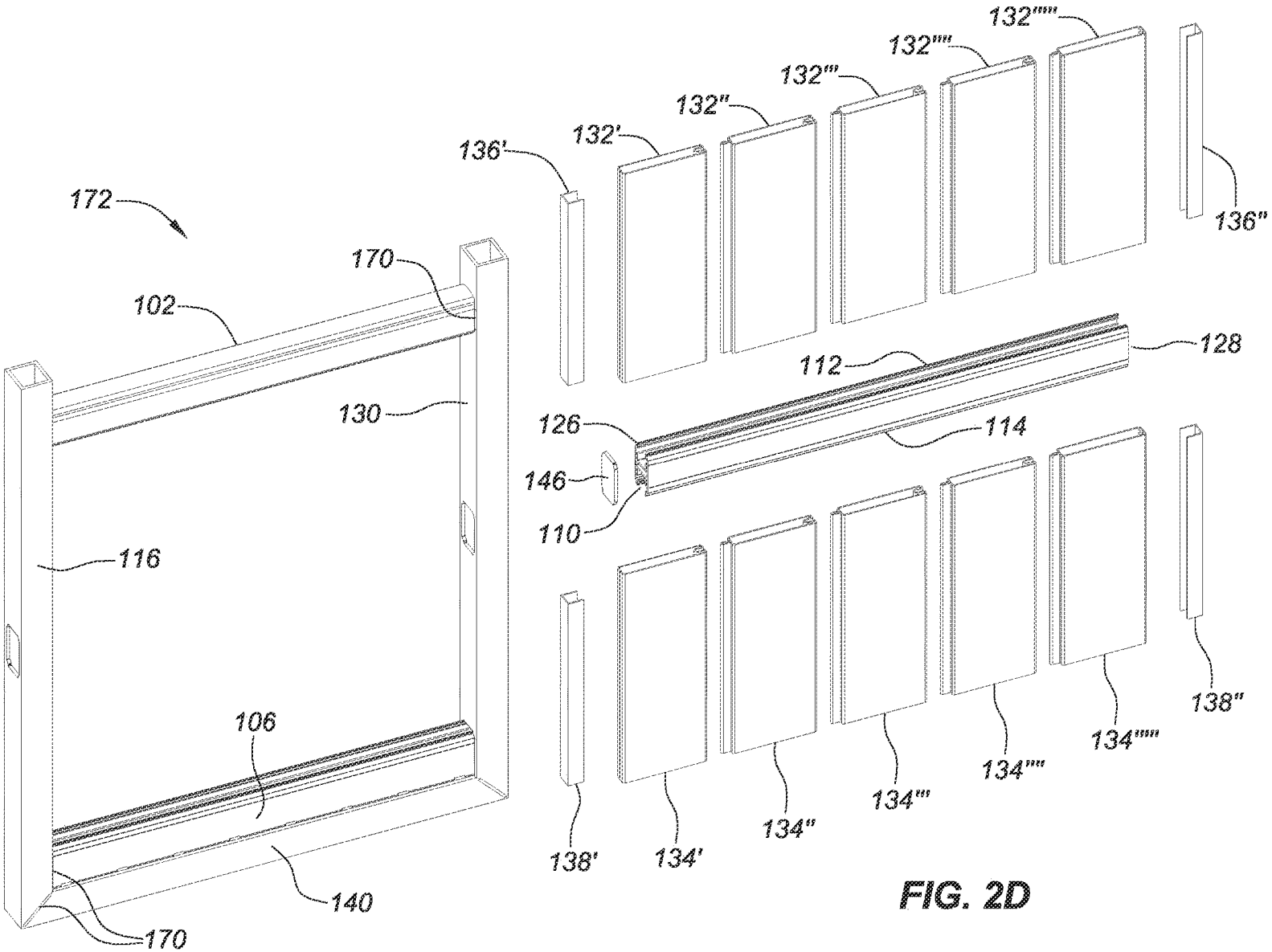
Figure 2E:
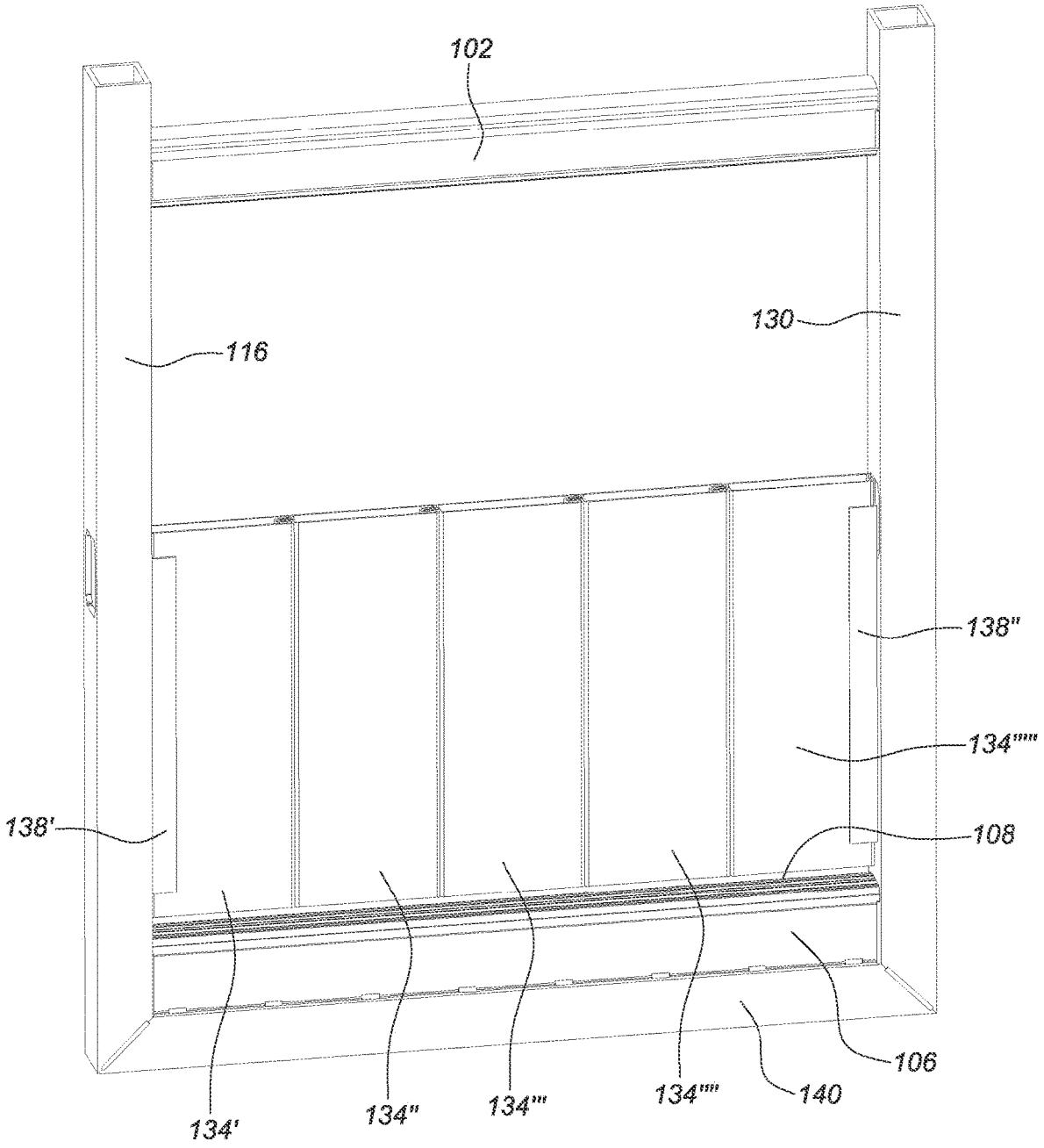
FIGS. 2E-2I are isometric views that illustrate insertion of a first planar barrier into a first channel defined by the top cross-member and a second planar barrier into a second channel defined by the bottom cross-member, in accordance with embodiments of the present disclosure.

FIGS. 2B to 2D depict the connection of the first vertical support member 116 (FIG. 2D), the second vertical support member 130, the bottom cross-member 106, and the bottom support member 140. In some embodiments, the bottom cross-member 106 can be inserted into the blind holes 154, 160 (FIG. 1A) formed in the bottom portions of the first vertical support member 116 and the second vertical support member 130. In an example, the first bottom cross-member end 122 of the bottom cross-member 106 can be inserted into the first blind hole 154 of the first vertical support member 116 and the second bottom cross-member end 124 of the bottom cross-member 106 can be inserted into the second blind hole 160 of the second vertical support member 130. In some embodiments, the first blind hole 154 and the second blind hole 160 can be sized such that the first bottom cross-member end 122 and the second bottom cross-member end 124 fit snugly into the blind holes 154, 160. As depicted, upon insertion of the first and second bottom cross-member ends 122, 124 into the blind holes 154, 160 and first and second top cross-member ends 118, 120 into blind holes 152, 158, one or more welds 170 can be formed around an intersection of the bottom cross-member 106 and top cross-member 102 and each of the first and second vertical support members 116, 130, as depicted in FIGS. 2C and 2D.

In some embodiments, the bottom support member 140 can be welded to the bottom cross-member 106 via a series of welds 170, as depicted, and the first vertical support member 116 and the second vertical support member 130 can be connected to one another via welds 170. In some embodiments, the first end of the bottom support member 140 and the second end of the bottom support member 140 can be cut at forty-five degree angles and the bottom of the first vertical support member 116 and the second vertical support member 130 can be cut at forty-five degree angles such that upon connection of the first and second vertical support members 116, 130 with the bottom support member 140, a ninety degree angle is formed between the first vertical support member 116 and the bottom support member 140 and the second vertical support member 130 and the bottom support member 140.

FIGS. 2C and 2D are isometric views that further illustrate connection of first and second vertical support members 116, 130 with the bottom cross-member 106 and bottom support member 140, in accordance with embodiments of the present disclosure. Upon connection of the first and second vertical support members 116, 130 with the top cross-member 102, the bottom cross-member 106, and bottom support member 140, a fencing assembly frame 172 can be formed, into which the planar barrier material 132, 134 and the fillers 136, 138 can be inserted. In some embodiments, the fillers 136, 138 can be formed as a u-channel and the ends of the outer planar barrier material 132, 134 can be inserted into a channel formed by the u-channel. In some embodiments, the fillers 136, 138 can fill a space between the edge of the planar barrier material 132, 134 and the first and second vertical support members (e.g., frames) 116, 130 and/or can provide a finished look to a cut edge of the planar barrier material 132, 134, which has been cut to size to fit between the first and second vertical support members 116, 130.

FIGS. 2E-2I are isometric views that illustrate insertion of a first planar barrier into a first channel defined by the top cross-member and a second planar barrier into a second channel defined by the bottom cross-member, in accordance with embodiments of the present disclosure. As depicted, the planar barrier material 134, 134 can have tongue and groove features, enabling each section of planar barrier material 132, 134 to interlock with another section of planar barrier material 132, 134, respectively. However, this is not required in some embodiments. The sections of planar barrier material 134', 134", 134''', 134'''', 134''''' have been assembled such that they are located side by side. The fillers 138', 138" have also been positioned on either side of the assembled sections of planar barrier material 134', 134", 134''', 134'''', 134'''''. As depicted, the sections of planar barrier material 134 are slid between the first vertical support member 116 and second vertical support member 130 and into the second channel 108, as further depicted in FIGS. 2D and 2F.

Figure 2F:
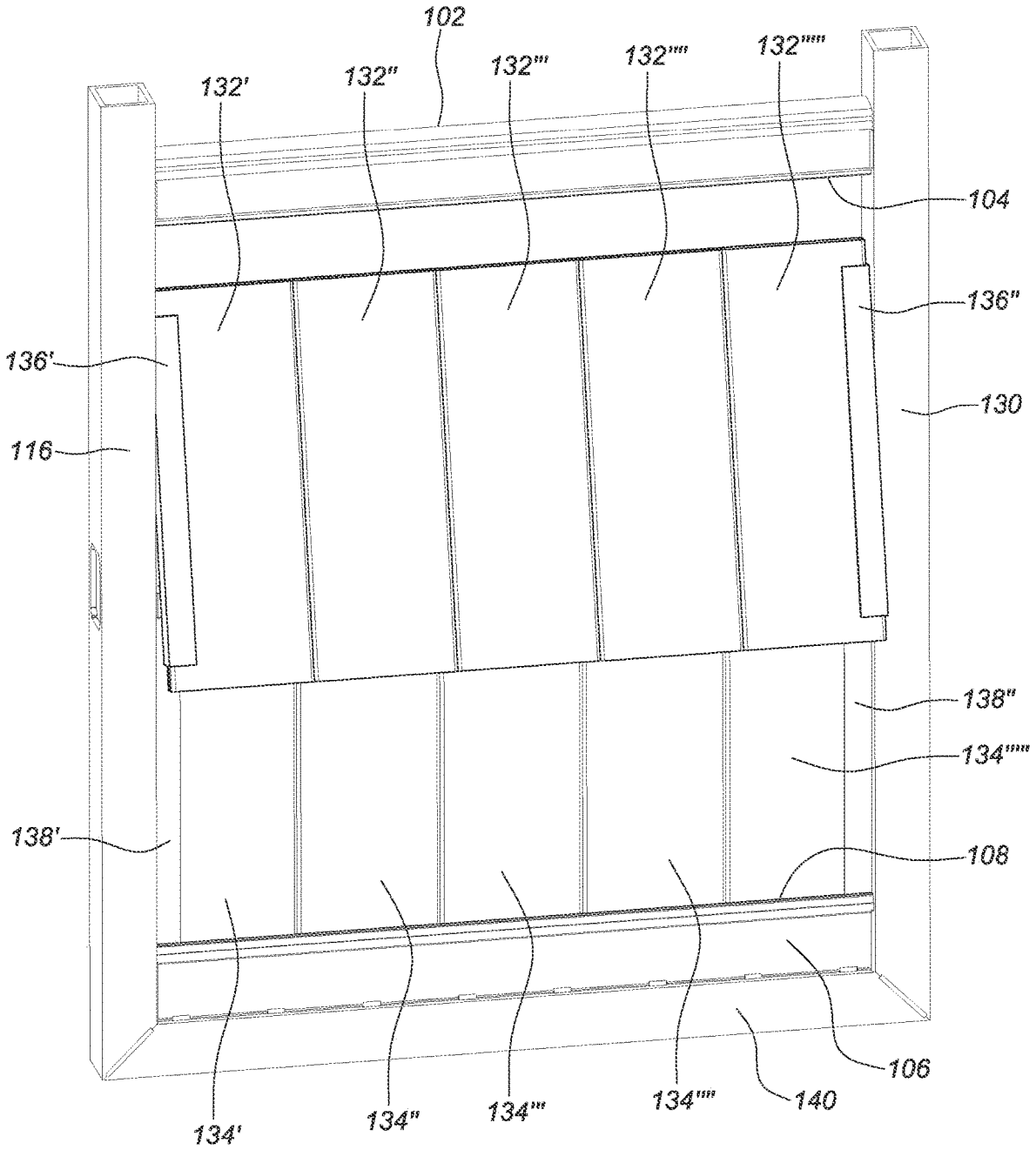

As depicted in FIG. 2F, the assembled sections of planar barrier material 132', 132", 132''', 132'''', 132''''' have been assembled such that they are located side by side. The fillers 136', 136" have also been positioned on either side of the assembled sections of planar barrier material 132', 132", 132''', 132'''', 132'''''. As depicted, the sections of planar barrier material 132 are slid between the first vertical support member 116 and second vertical support member 130 and into the first channel 104, as further depicted in FIGS. 2F and 2G.

Figure 2G:
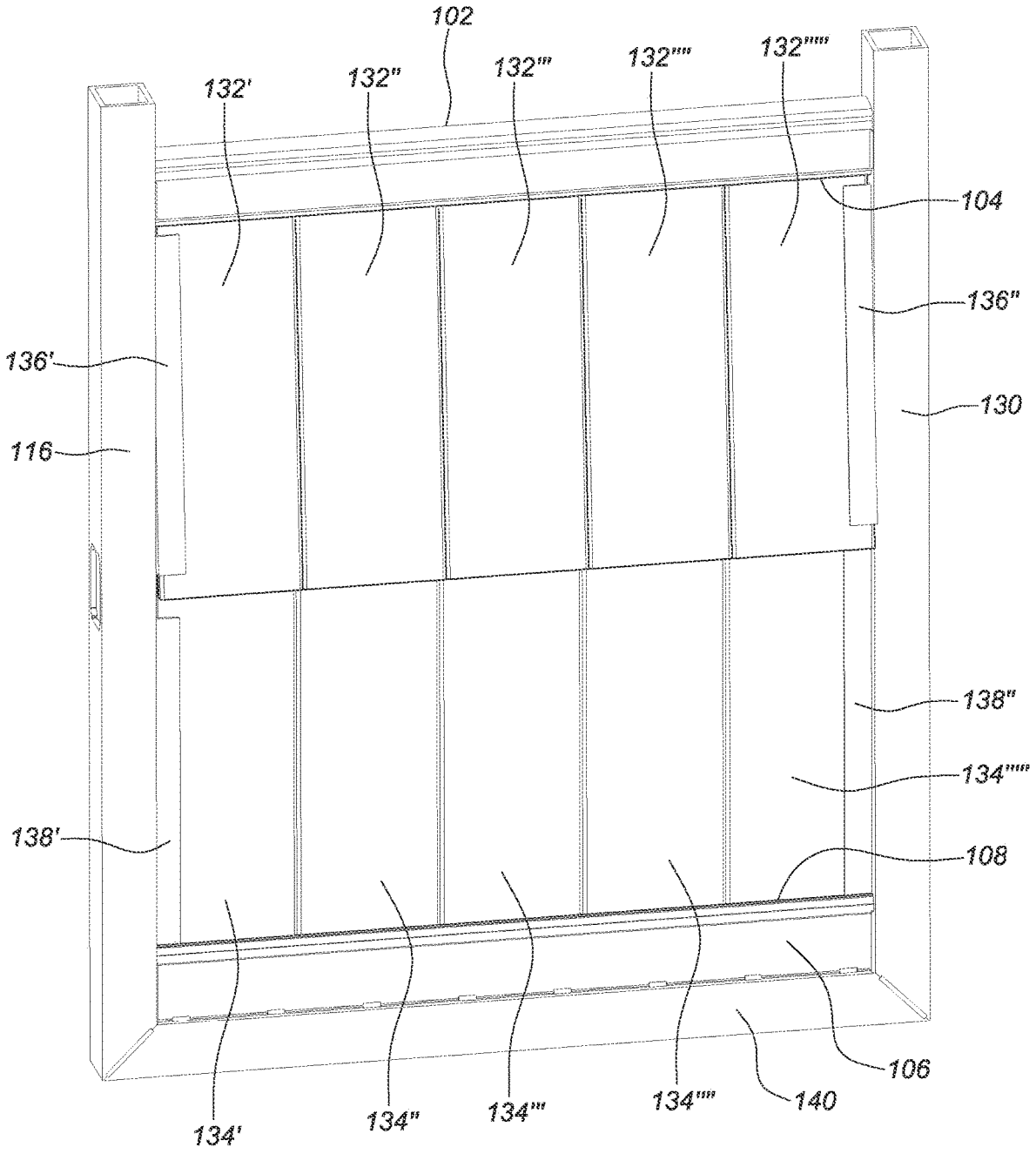
Figure 2H:
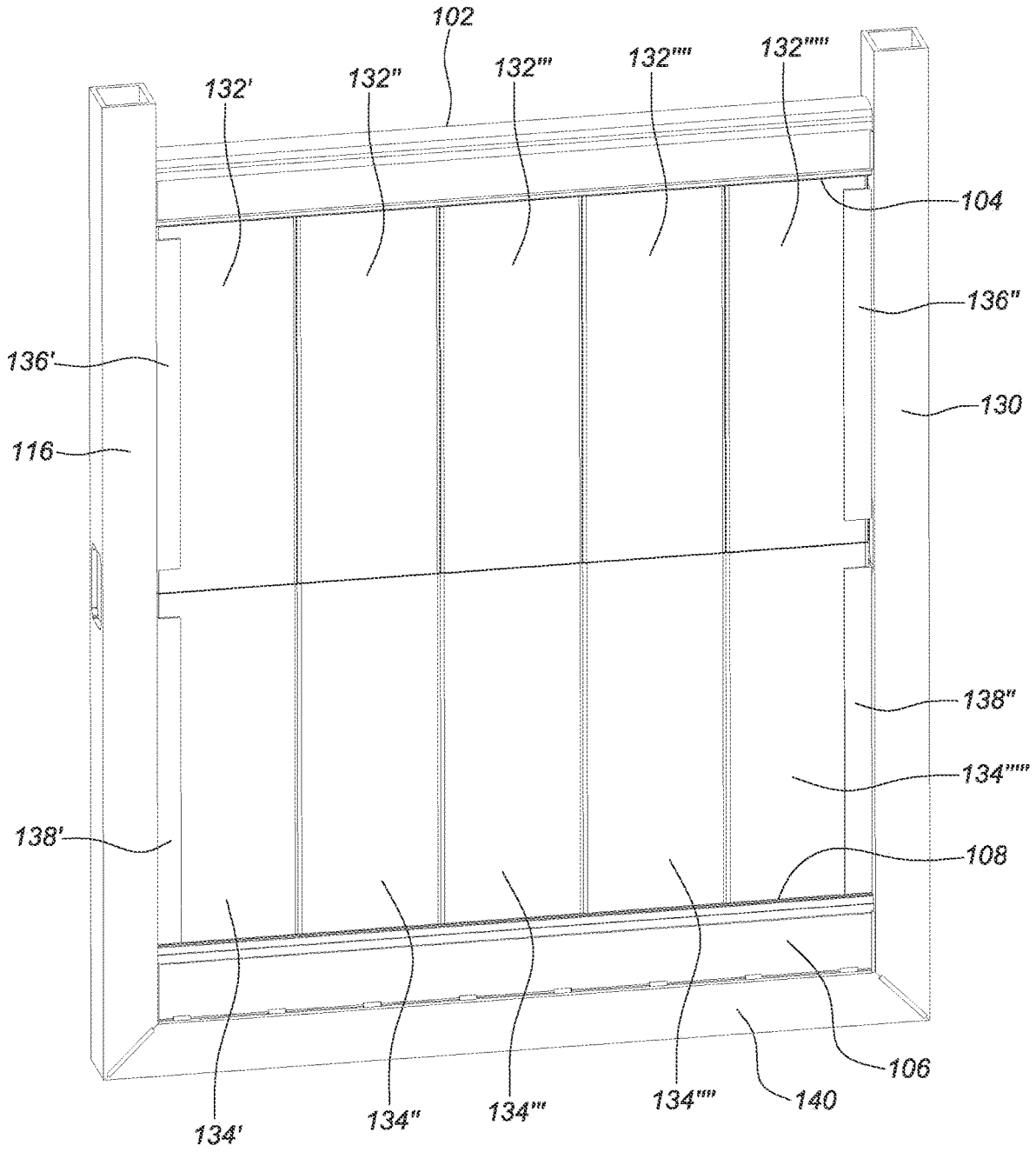

As depicted in FIG. 2H, the first planar barriers 132, 134 have been inserted between the first and second vertical support members 116, 130 and at least partially into the first channel 104 and second channel 108. As depicted, no gap exists between the first planar barrier 132 and the second planar barrier 134.

Figure 2I:
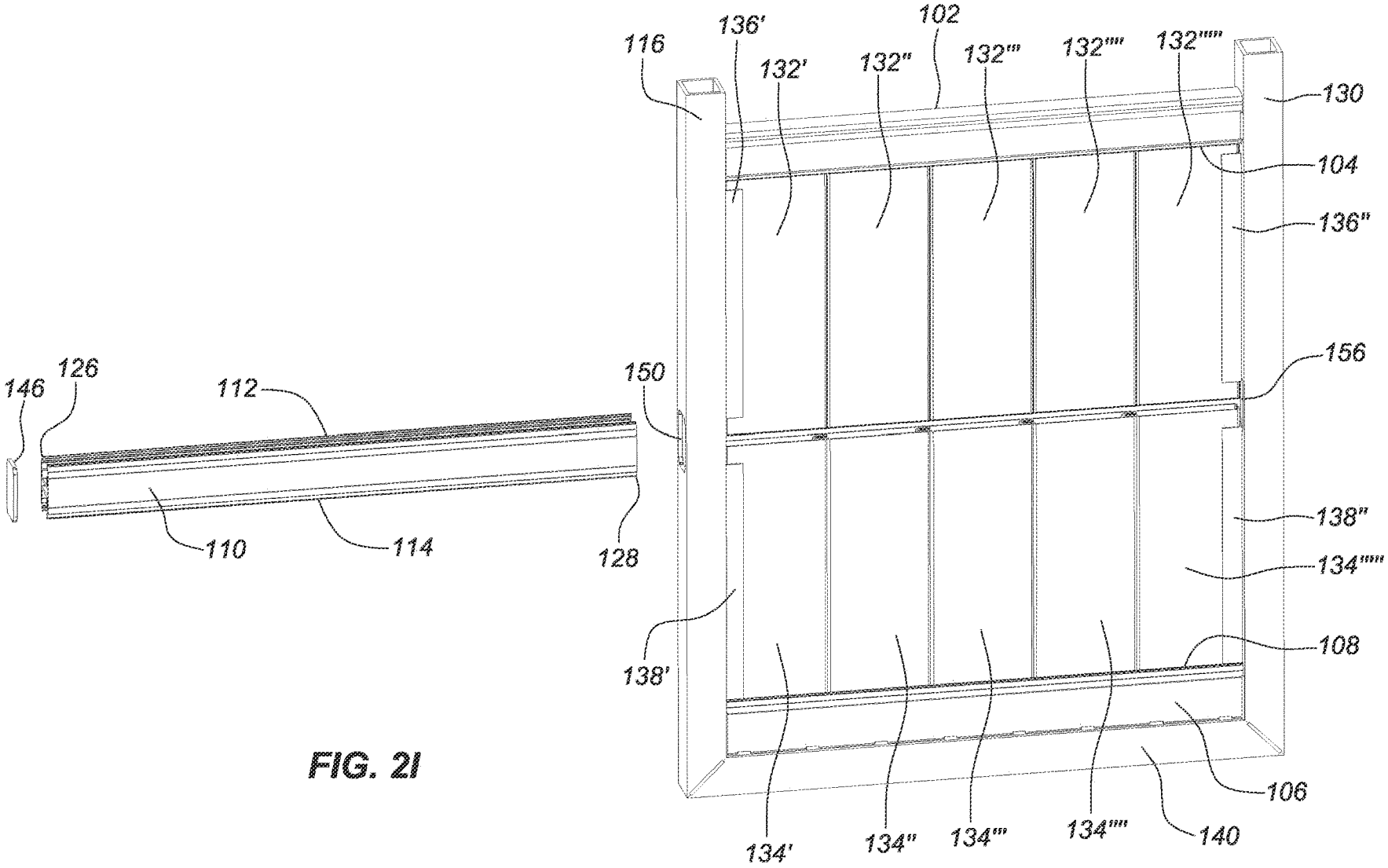

As depicted in FIG. 2I, in some embodiments, the first planar barrier 132 can be inserted up into the first channel 104, thus creating a gap between the first planar barrier 132 and the second planar barrier 134. Upon insertion of the planar barriers 132, 134 into the first channel 104 and the second channel 108, a top of the planar barrier 134 and a bottom of the planar barrier 132 can extend to a height of the thru hole 150 formed in the middle of the vertical support member 116 and to a height of the blind hole 156 formed in the middle of the second vertical support member 130. In an example, the planar barrier material 132, 134 can cover a portion of each one of the thru hole 150 and blind hole 156. Accordingly, a solid piece of material that is of a size and shape to fit through the holes 150, 156 cannot be inserted because the planar barrier material 132, 134 obstructs a path between the holes 150, 156. Accordingly, the middle cross-member 110 can include a third channel 112 and a fourth channel 114, as further discussed herein.

Figure 2J:
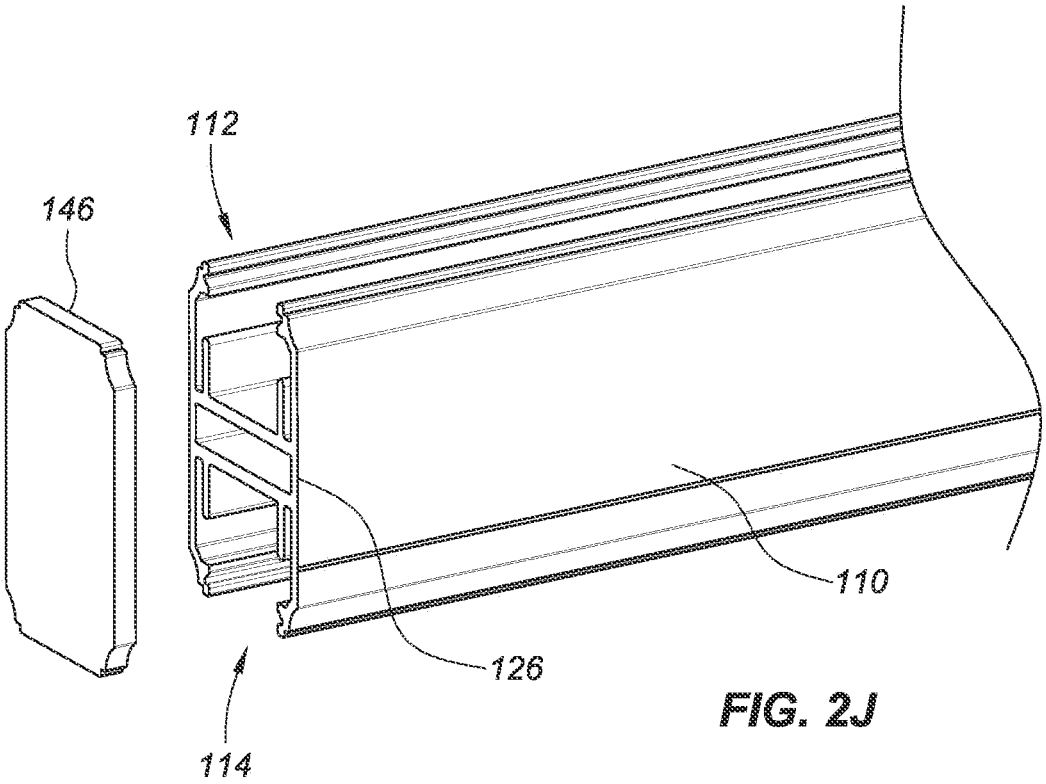
FIGS. 2J and 2K are isometric views that illustrate connection of an end plate to a first end of a middle cross-member, in accordance with embodiments of the present disclosure.
Figure 2K:
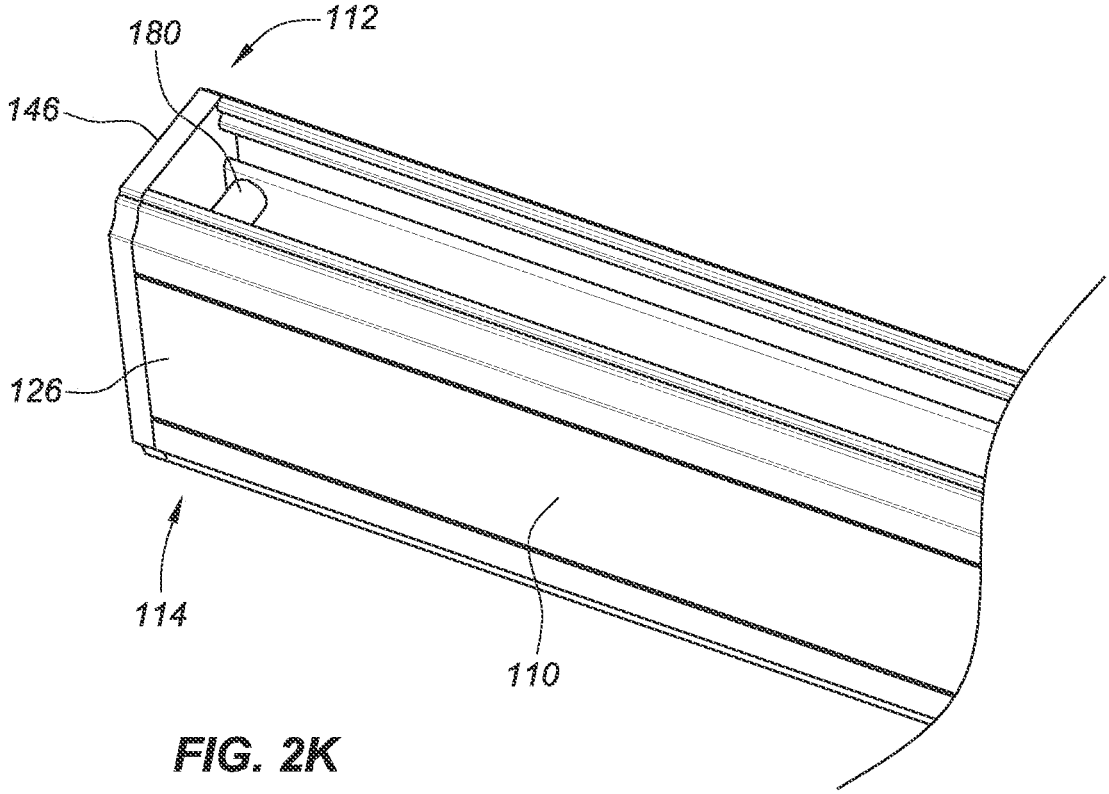

FIGS. 2J and 1K are isometric views that illustrate connection of the end plate 146 to the first end of the middle cross-member 110, in accordance with embodiments of the present disclosure. FIGS. 2J and 2K further depict the third channel 112 and the fourth channel 114 defined by a top and bottom surface of the middle cross-member 110, a configuration of which is further discussed in relation to FIGS. 3A to 3C. In an example, the top portion of the planar barrier material 134 can disposed in the channel 114 and the bottom portion of the planar barrier material 132 can be disposed in the channel 112, as further discussed herein.

FIGS. 2J and 2K further depict the connection of the end plate 146 to first middle cross-member end 126. In some embodiments, the end plate 146 can have a same cross-sectional profile as the middle cross-member, with the exception that the end plate 146 further includes material where the channels 112, 114 are defined in the middle cross-member 110. In some embodiments, as depicted in FIG. 2K, the end plate 146 can be connected to the first middle cross-member end 126. In some embodiments, the end plate 146 can be connected to the first middle cross-member end 126 via one or more welds 180. Upon connection of the end plate 146 to the first middle cross-member end 126, the end plate 146 can give the appearance that the first middle cross-member 110 is a solid piece of material and can also cover a lumen formed by the tubular piece of material and can cover the channels 112, 114, an importance of which is further discussed herein in relation to FIGS. 2L to 2O, for example.

Figure 2L:
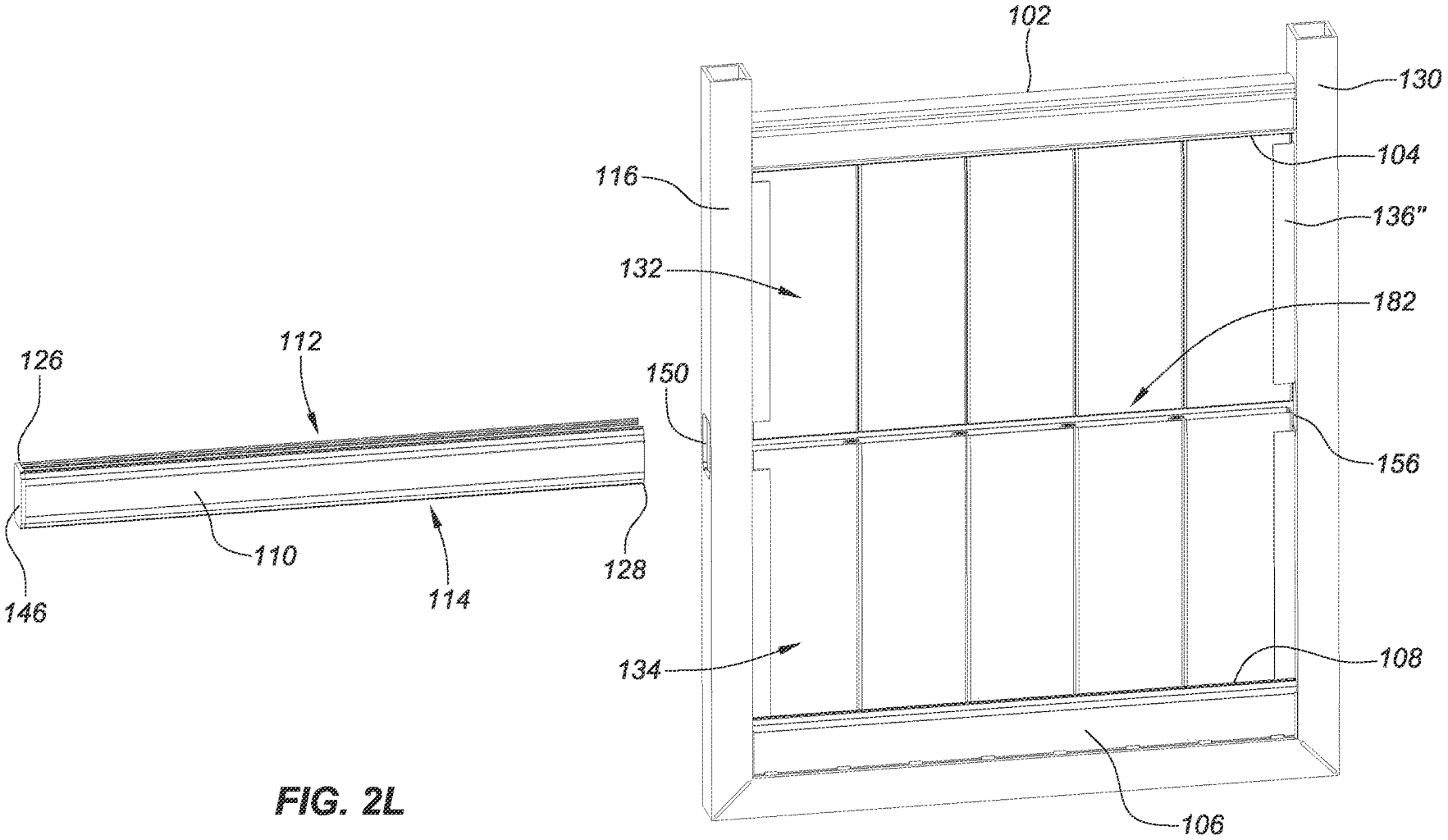
FIGS. 2L-2O are isometric views that illustrate connection of the middle cross-member with the first vertical support member, the second vertical support member, and the first and second planar barriers, in accordance with embodiments of the present disclosure.
Figure 2M:
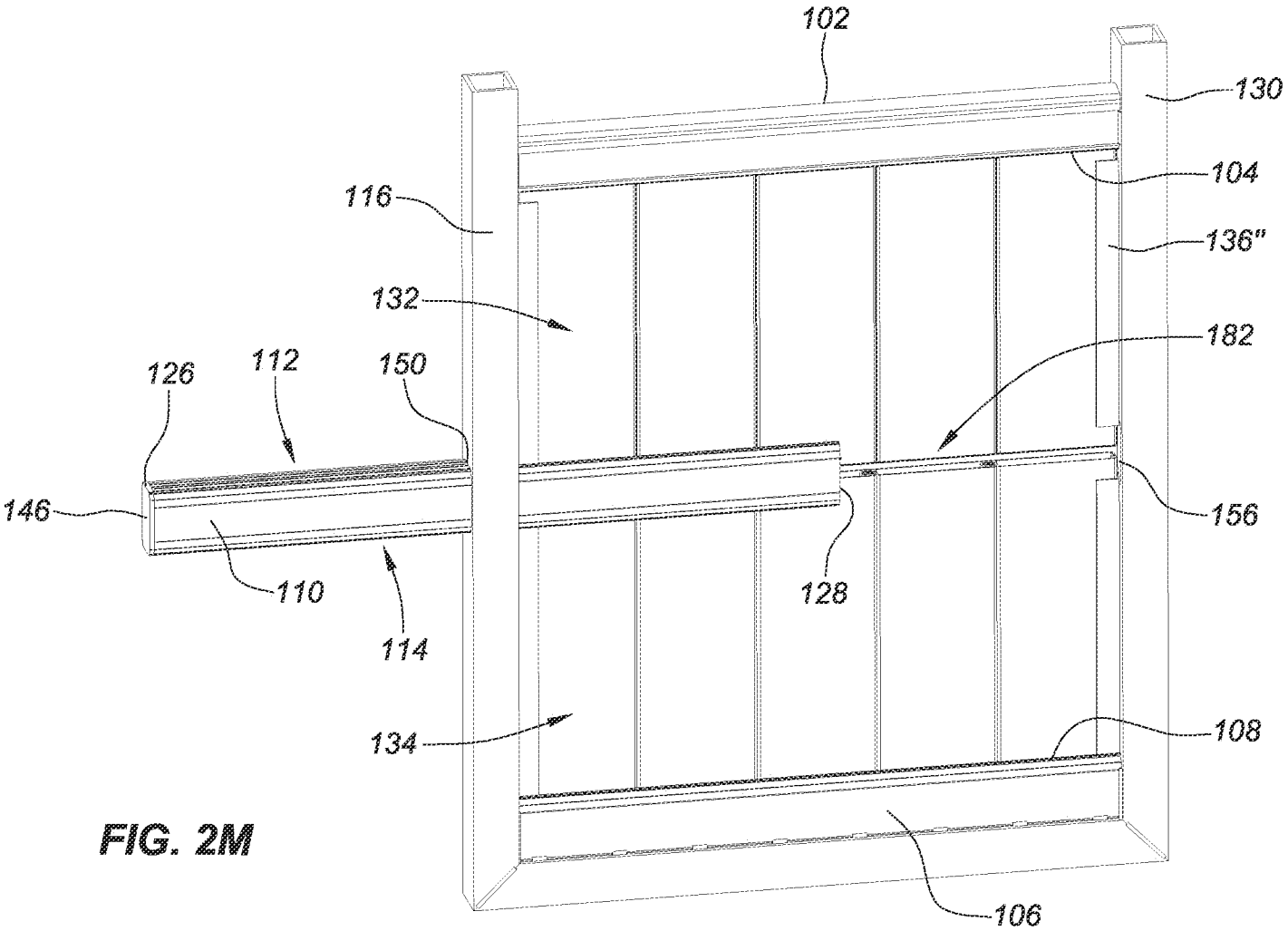

FIGS. 2L-2M are isometric views that illustrate connection of the middle cross-member 110 with the first vertical support member 116, the second vertical support member 130, and the planar barriers 132, 134, in accordance with embodiments of the present disclosure. In some embodiments, the end plate 146 can only be connected to the first middle cross-member end 126, such that the channels 112, 114 are exposed on the second middle cross-member end 128. This can enable the second middle cross-member end 128 to be inserted through the through hole 150 and through the space separating the first vertical support member 116 and the second vertical support member 130 through the gap 182 existing between the first and second planar barriers 132, 134 and into the blind hole 156 defined in the second vertical support member 130. In an example, the third channel 112 can pass over the bottom portion of the planar barrier 132 and the fourth channel 14 can pass over the top portion of the planar barrier 134, locking the first planar barrier 132 into place in the third channel 112 and locking the second planar barrier 134 into place in the fourth channel 114, as the second middle cross-member end 128 is inserted into the blind hole 156. As depicted in FIG. 2M, the middle cross-member 110 has been inserted about half way between the first vertical support member 116 and the second vertical support member 130.

Figure 2N:
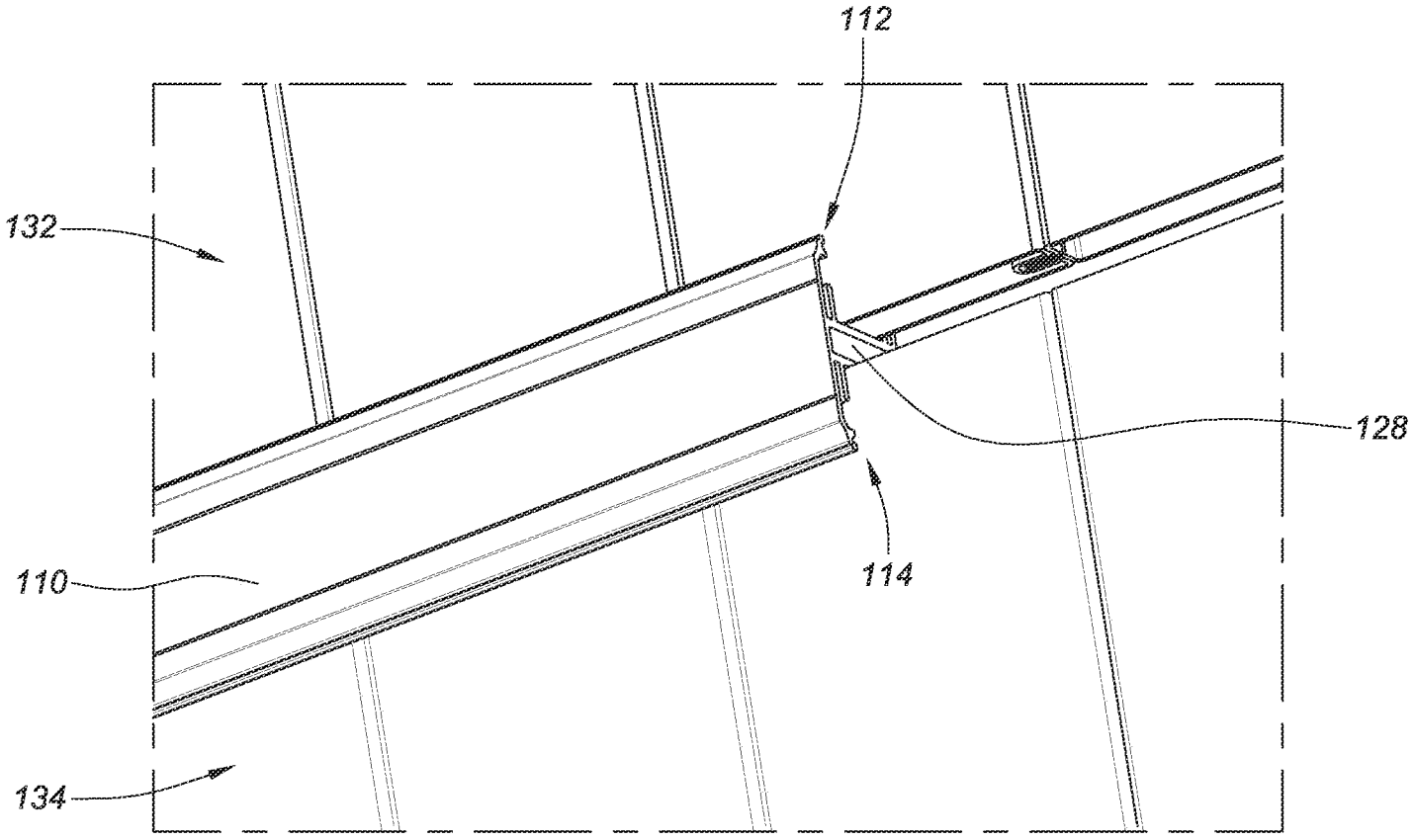
Figure 2O:
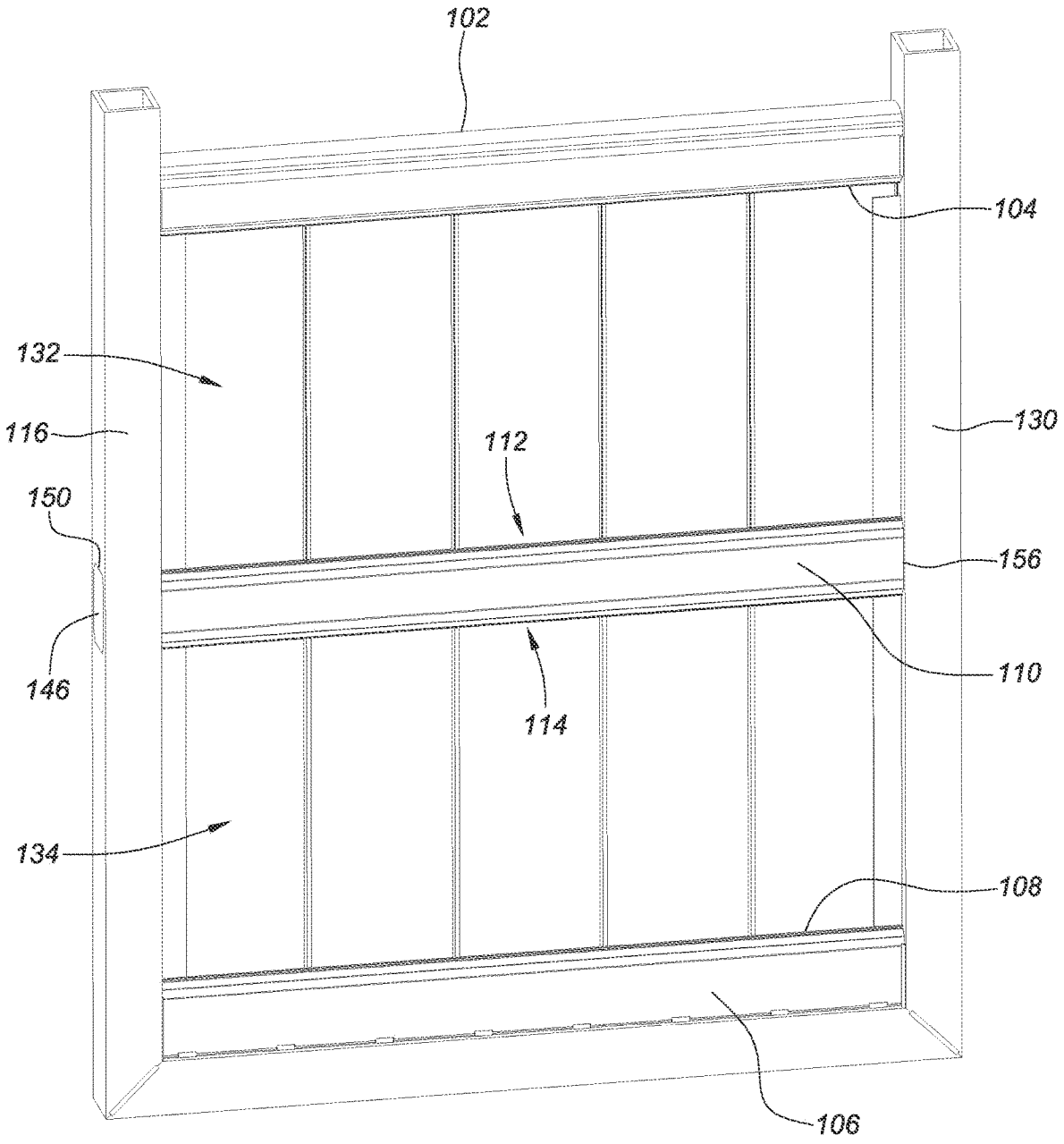

FIG. 2N illustrates an isometric close-up view of the planar barriers 132, 134, which are illustrated as being hollow in FIG. 2N, passing through the third and fourth channels 112, 114 of the middle cross-member 110, respectively. A portion of the middle cross-member disposed between the third channel 112 and the fourth channel 114 is depicted as sliding through the gap 182 existing between the first planar barrier 132 and the second planar barrier 134. FIG. 2O depicts the middle cross-member 110 as fully inserted into the blind hole 156 and across a bottom of the first planar barrier 132 and a top of the second planar barrier 134, thus securing the planar barriers 132, 134 in place. As further depicted, upon full insertion of the middle cross-member 110 into the blind hole 156, the end plate 146 can be flush or relatively flush with an outside wall of the first vertical support member 116, thus providing a seamless fencing assembly. In some embodiments, a pair of fasteners (as discussed in relation to FIG. 1L) can be driven through the first vertical support member 116 and the second vertical support member 130 at an intersection of the middle cross-member 110 with each of the first vertical support member 116 and second vertical support member 130. In some embodiments, the fasteners can be screws, such as sheet metal screws. Upon full assembly of fencing assembly, the planar barriers 132, 134 can be locked into place via the first channel 104, second channel 108, third channel 112, and the fourth channel 114, which oppose one another.

Figure 3C:
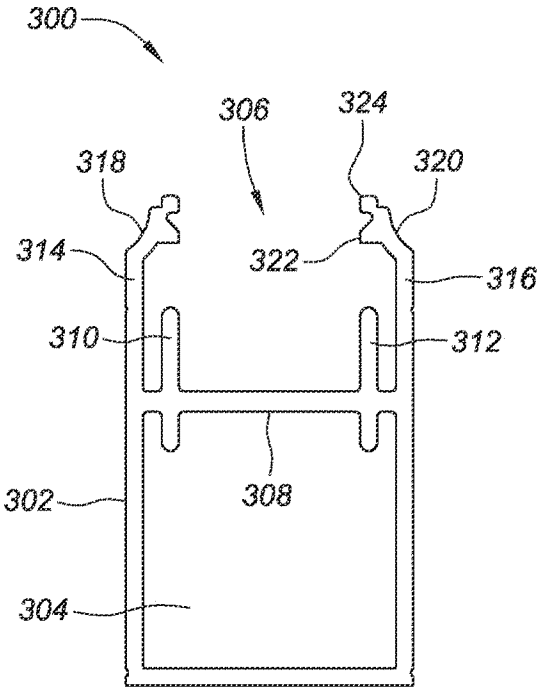
FIGS. 3A-3C are cross-sectional end views of the top cross-member, middle cross-member, and bottom cross-member depicted in FIGS. 2A to 2O, in accordance with embodiments of the present disclosure.
Figure 3B:
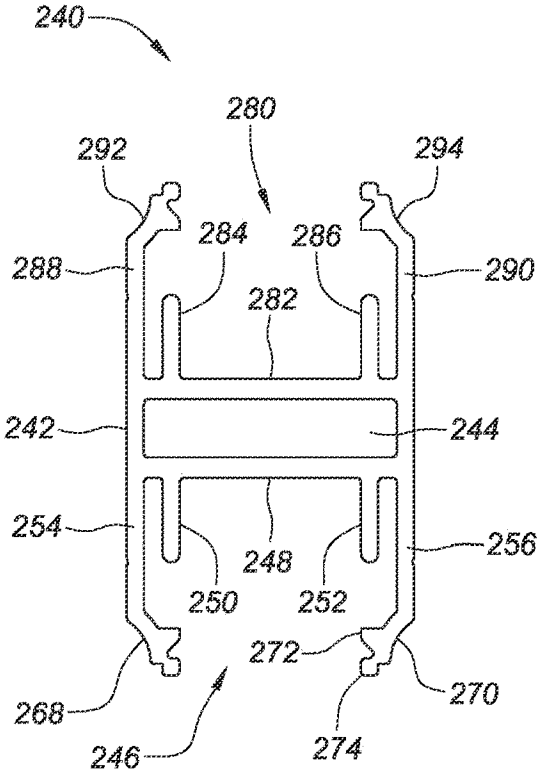
Figure 3A:
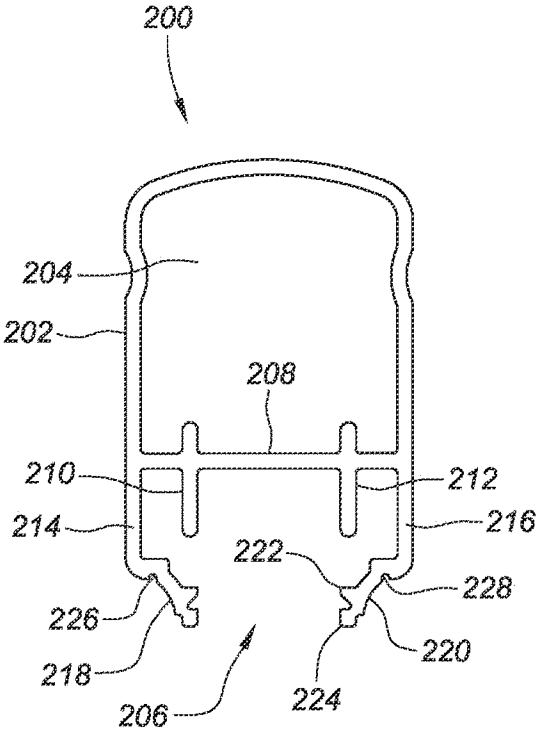

FIGS. 3A-3C are cross-sectional end views of the top cross-member 200, middle cross-member 240, and bottom cross-member 300, as further depicted in FIGS. 2A to 2O, in accordance with embodiments of the present disclosure. In some embodiments, FIGS. 3A and 3C can represent the top cross-member and bottom cross-member depicted in FIGS. 1A to 1L.

As depicted in FIG. 3A, in some embodiments, the top cross-member 200 can include a body portion 202. The body portion 202 can be a longitudinally extending tubular body that defines a lumen 204 extending therethrough. In some embodiments, the body portion 202 can define a channel 206 that longitudinally extends along a bottom surface of the body portion 202 and is defined by channel features that extend from the bottom surface 208 of the body portion 202. In an example, the channel features can include a first channel wall 210 and a second channel wall 212 that extend perpendicularly from the bottom surface 208 and away from the body portion 202. In some embodiments, the first and second channel walls 210, 212 can extend away from the body portion 202, but may not be perpendicular to the bottom surface 208. In some embodiments, a planar barrier, as discussed herein can be disposed between the first and second channel walls 210, 212 and the first and second channel walls 210, 212 can be configured to prevent movement of the planar barrier material (e.g., from side to side). In some embodiments, a distance between opposing surfaces of the first and second channel walls 210, 212 can be slightly larger than a thickness of the planar barrier material to allow the planar barrier material to slide between the first and second channel walls 210, 212.

In some embodiments, the top cross-member can include a first and second shoulder support 214, 216 that extend perpendicular to and away from the bottom surface 208. In some embodiments, the first and second shoulder support 214, 216 extend from outer edges of the bottom surface 208 and run along a longitudinal length of the bottom surface. In some embodiments, a first and second shoulder portion 218, 220 can extend from the first and second shoulder supports 214, 216, respectively. In some embodiments, the first and second shoulder portions 218, 220 can extend at an angle from an end of the first and second shoulder supports 214, 216 and can extend toward one another. In an example, opposing faces of the first and second shoulder portions 218, 220 can include retention features 222, 224, such as those shown in the second shoulder portion 220. In an example, the retention feature 222 can be designed to allow for the insertion and retention of the planar barrier material. For example, as depicted, the retention feature 222 can include an angled face on an entrance side of the retention feature 222, allowing for the insertion of the planar barrier material, but may not include an angled face on an exit side of the retention feature 222.

In some embodiments, a distance between the opposing faces of the first and second shoulder portions 218, 220 can be equal to a distance between opposing faces of the first and second channel walls 210, 212. In some embodiments, a distance between the opposing faces of the first and second shoulder portions 218, 220 can be greater than a distance between opposing faces of the first and second channel walls 210, 212. In some embodiments, a distance between the opposing faces of the first and second shoulder portions 218, 220 can be less than a distance between opposing faces of the first and second channel walls 210, 212. In some embodiments, relief cuts 226, 228 can be formed along an interface between the shoulder portions 218, 220 and the shoulder support portions 214, 216, respectively. As depicted in FIG. 2G, the first planar barrier material 132 can be angled upon insertion into the first channel 104. Accordingly, the relief cuts 226, 228, can allow for some flexing of the shoulder portions 218, 220, to allow for the angling of the first planar barrier material 132 when inserting the first planar barrier material.

As depicted in FIG. 3B, in some embodiments, the middle cross-member 240 can include a body portion 242. The body portion 242 can be a longitudinally extending tubular body that defines a lumen 244 extending therethrough. In some embodiments, the body portion 242 can define a first channel 246 that longitudinally extends along a bottom surface 248 of the body portion 242 and is defined by channel features that extend from the bottom surface 248 of the body portion 242. In an example, the channel features can include a first channel wall 250 and a second channel wall 252 that extend perpendicularly from the bottom surface 248 and away from the body portion 242. In some embodiments, the first and second channel walls 250, 252 can extend away from the body portion 242, but may not be perpendicular to the bottom surface 248. In some embodiments, a planar barrier, as discussed herein can be disposed between the first and second channel walls 250, 252 and the first and second channel walls 250, 252 can be configured to prevent movement of the planar barrier material (e.g., from side to side). In some embodiments, a distance between opposing surfaces of the first and second channel walls 250, 252 can be slightly larger than a thickness of the planar barrier material to allow the planar barrier material to slide between the first and second channel walls 250, 252.

In some embodiments, the middle cross-member can include a first and second shoulder support 254, 256 that extend perpendicular to and away from the bottom surface 248. In some embodiments, the first and second shoulder support 254, 256 extend from outer edges of the bottom surface 248 and run along a longitudinal length of the bottom surface. In some embodiments, a first and second shoulder portion 268, 270 can extend from the first and second shoulder supports 254, 256, respectively. In some embodiments, the first and second shoulder portions 268, 270 can extend at an angle from an end of the first and second shoulder supports 254, 256 and can extend toward one another. In an example, opposing faces of the first and second shoulder portions 268, 270 can include retention features 272, 274, such as those shown in the second shoulder portion 270. In an example, the retention feature 272 can be designed to allow for the insertion and retention of the planar barrier material. For example, as depicted, the retention feature can include an angled face on an entrance side of the retention feature, allowing for the insertion of the planar barrier material, but may not include an angled face on an exit side of the retention feature.

In some embodiments, a distance between the opposing faces of the first and second shoulder portions 268, 270 can be equal to a distance between opposing faces of the first and second channel walls 250, 252. In some embodiments, a distance between the opposing faces of the first and second shoulder portions 268, 270 can be greater than a distance between opposing faces of the first and second channel walls 250, 252. In some embodiments, a distance between the opposing faces of the first and second shoulder portions 268, 270 can be less than a distance between opposing faces of the first and second channel walls 250, 252.

A top surface 282 of the body portion 242 can include similar or the same features as the bottom surface 248. For example, as further depicted in FIG. 3B, in some embodiments, the body portion 242 can define a second channel 280 that longitudinally extends along a top surface 282 of the body portion 242 and is defined by channel features that extend from the top surface 282 of the body portion 242. In an example, the channel features can include a third channel wall 284 and a fourth channel wall 286 that extend perpendicularly from the top surface 282 and away from the body portion 242.

In some embodiments, the middle cross-member can include a first and second shoulder support 280, 290 that extend perpendicular to and away from the top surface 282, as discussed above. In some embodiments, a first and second shoulder portion 292, 294 can extend from the first and second shoulder supports 288, 290, respectively, and can include retention features as discussed above.

As depicted in FIG. 3C, in some embodiments, the bottom cross-member 300 can include a body portion 302. The body portion 302 can be a longitudinally extending tubular body that defines a lumen 304 extending therethrough. In some embodiments, the body portion 302 can have define a channel 306 that longitudinally extends along a top surface 308 of the body portion 302 and is defined by channel features that extend from the top surface 308 of the body portion 302. In an example, the channel features can include a first channel wall 310 and a second channel wall 312 that extend perpendicularly from the top surface 308 and away from the body portion 302. In some embodiments, the first and second channel walls 310, 312 can extend away from the body portion 302, but may not be perpendicular to the top surface 308. In some embodiments, a planar barrier, as discussed herein can be disposed between the first and second channel walls 310, 312 and the first and second channel walls 310, 312 can be configured to prevent movement of the planar barrier material (e.g., from side to side). In some embodiments, a distance between opposing surfaces of the first and second channel walls 310, 312 can be slightly larger than a thickness of the planar barrier material to allow the planar barrier material to slide between the first and second channel walls 310, 312. In some embodiments, a pair of third and fourth channel walls can extend opposite from the first and second channel walls on an opposite side of the top surface 308. The third and fourth channel walls can provide support to the bottom cross-member when it is under load. For example, the third and fourth channel walls can help to prevent flexing of the bottom cross-member 300.

In some embodiments, the bottom cross-member 300 can include a first and second shoulder support 314, 316 that extend perpendicular to and away from the top surface 308. In some embodiments, the first and second shoulder support 314, 316 extend from outer edges of the top surface 308 and run along a longitudinal length of the bottom surface. In some embodiments, a first and second shoulder portion 318, 320 can extend from the first and second shoulder supports 314, 316, respectively. In some embodiments, the first and second shoulder portions 318, 320 can extend at an angle from an end of the first and second shoulder supports 314, 316 and can extend toward one another. In an example, opposing faces of the first and second shoulder portions 318, 320 can include retention features 322, 324, such as those shown in the second shoulder portion 320. In an example, the retention feature 322 can be designed to allow for the insertion and retention of the planar barrier material. For example, as depicted, the retention feature 322 can include an angled face on an entrance side of the retention feature 322, allowing for the insertion of the planar barrier material, but may not include an angled face on an exit side of the retention feature 322.

In some embodiments, a distance between the opposing faces of the first and second shoulder portions 318, 320 can be equal to a distance between opposing faces of the first and second channel walls 310, 312. In some embodiments, a distance between the opposing faces of the first and second shoulder portions 318, 320 can be greater than a distance between opposing faces of the first and second channel walls 310, 312. In some embodiments, a distance between the opposing faces of the first and second shoulder portions 318, 320 can be less than a distance between opposing faces of the first and second channel walls 310, 312.

Figure 4A:
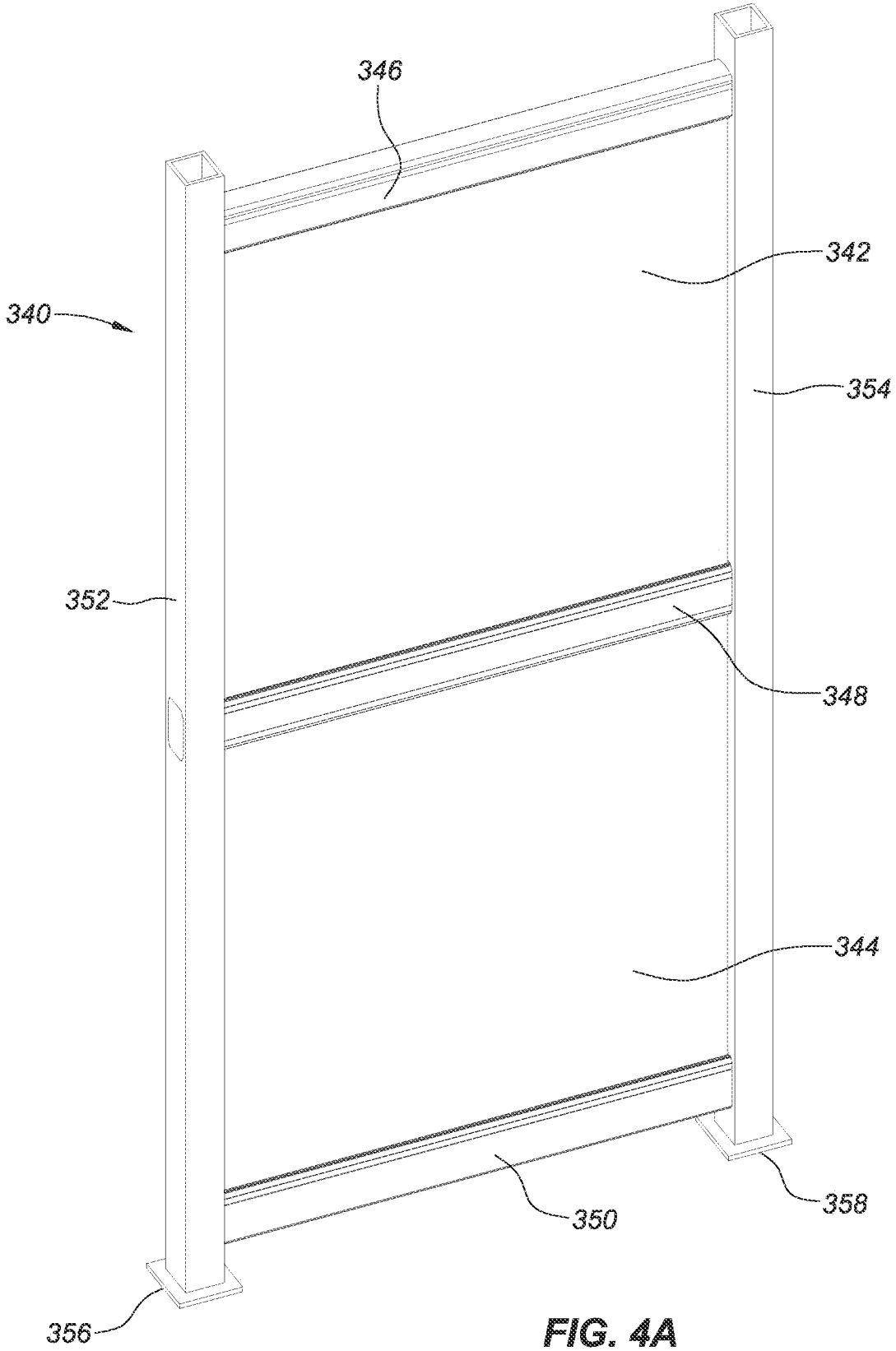
FIG. 4A is an isometric side view of a fencing assembly that includes glass panels, in accordance with embodiments of the present disclosure.

FIG. 4A is an isometric side view of a fencing assembly 340 that includes glass panels 342, 344, in accordance with embodiments of the present disclosure. In some embodiments, the fencing assembly 340 can include a top cross-member 346, a middle cross-member 348, bottom cross-member 350, first vertical support member 352, and second vertical support member 354. A first glass panel 342 can be inserted into a frame created by the top cross-member 346, middle cross-member 348, first vertical support 352, and second vertical support 354. A second glass panel 344 can be inserted into a frame created by the middle cross-member 348, bottom cross-member 350, first vertical support 352, and second vertical support 354. As depicted, in some embodiments, the fencing assembly 340 can be a section of fence that is mounted to a ground via mounts 356, 358.

Figure 4B:
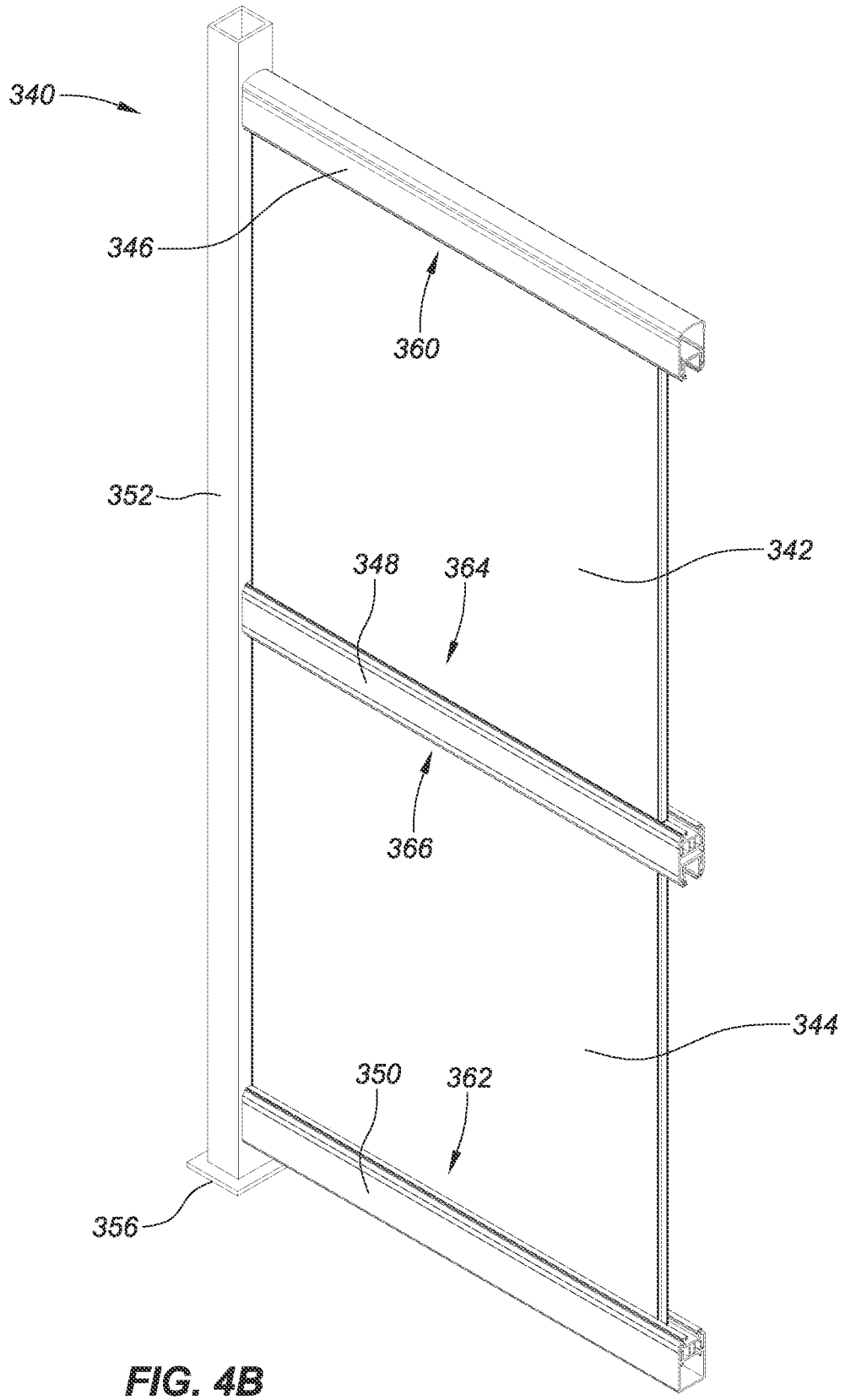
FIG. 4B is a cross-sectional isometric end view of the fencing assembly depicted in FIG. 4A, in accordance with embodiments of the present disclosure.

FIG. 4B is a cross-sectional isometric end view of the fencing assembly depicted in FIG. 4A, in accordance with embodiments of the present disclosure. In some embodiments, the top cross-member 346 can define a first cross-member channel 360 in which the first glass panel 342 can be inserted; the bottom cross-member 350 can define a second cross-member channel 362 in which the second glass panel 344 can be inserted; the middle cross-member 348 can define a third cross-member channel 364 in which the first glass panel 342 can be inserted and a fourth cross-member channel 366 in which the second glass panel 344 can be inserted. In some embodiments, the first glass panel 342 can be inserted up into the first cross-member channel 360 such that the first glass panel 342 extends up over the middle cross-member 348 and can then be dropped down into the third cross-member channel 364. Similarly, in some embodiments, the second glass panel 344 can be inserted up into the fourth cross-member channel 366 such that the second glass panel 344 extends up over the bottom cross-member 350 and can then be dropped down into the second cross-member channel 364. In some embodiments, each one of the first, second, third, and fourth cross-member channels 360, 362, 364, 366 can have a gasket disposed in the channels, as further depicted in FIG. 4C.

Figure 4C:
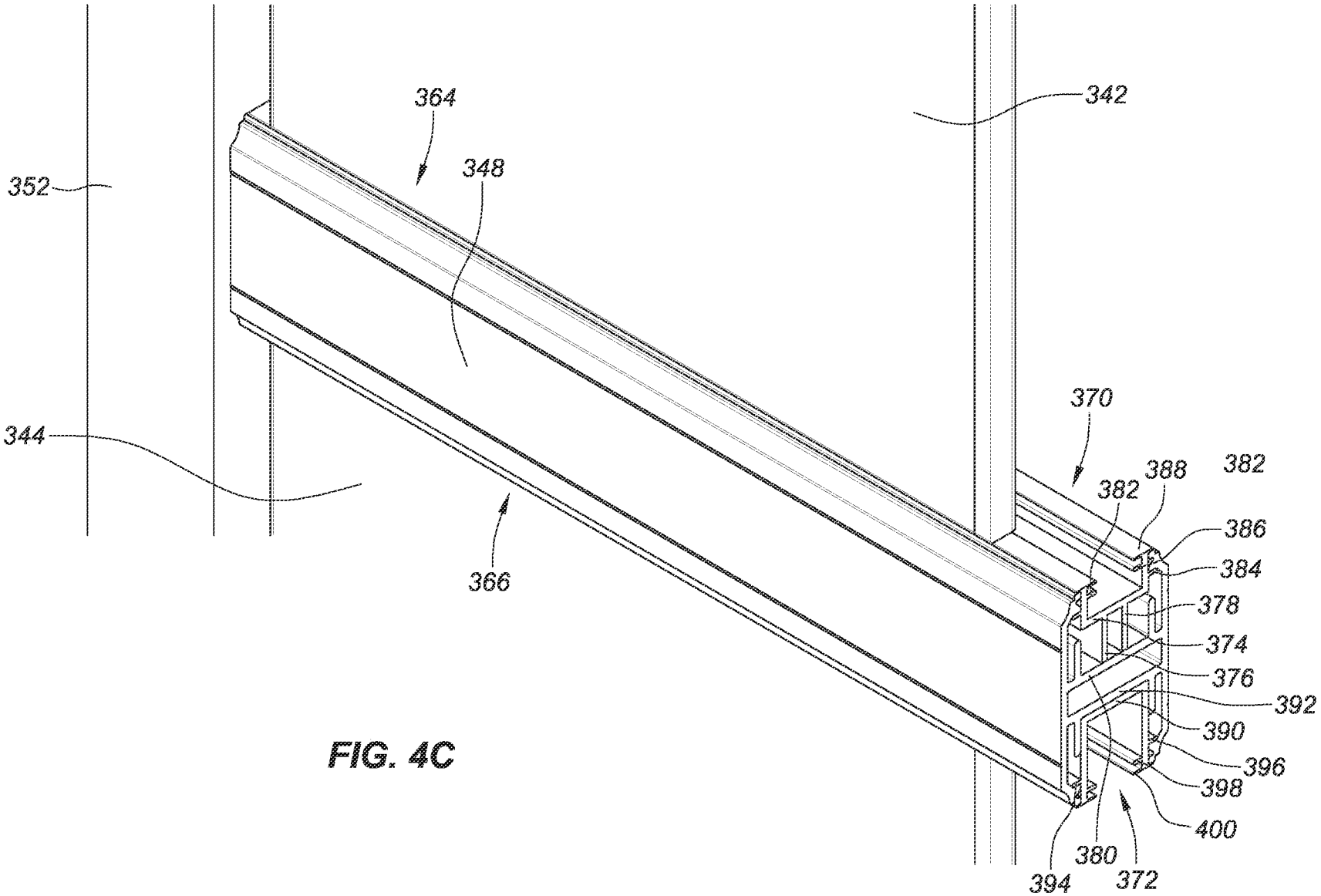
FIG. 4C is a cross-sectional isometric end view of a pair of gaskets disposed in a third channel and fourth channel defined by the middle cross-member, in accordance with embodiments of the present disclosure.

FIG. 4C is a cross-sectional isometric end view of a pair of gaskets 370, 372 disposed in the third channel 364 and fourth channel 366 defined by the middle cross-member 348, in accordance with embodiments of the present disclosure. As depicted, a bottom of the first glass panel 342 can be inserted into the first gasket 370 and a top of the second glass panel 344 can be inserted into the second gasket 372. In some embodiments, the top cross-member 346 can include a similar or same gasket as the second gasket 372 in the fourth channel 366 (FIG. 4B) and the bottom cross-member 350 can include a similar or same gasket as the first gasket 370 in the third channel 364 (FIG. 4B).

In some embodiments, the first gasket 370 can include a u-shaped body portion 374, which can be inserted into the third channel 364. In an example, one or more vertical supports 376, 378 extend downward from a base of the u-shaped body portion 374 to a top surface 380 of a body portion of the middle cross-member 348. In some embodiments, the vertical supports 376, 378 can be configured to support the base of the u-shaped body portion under a weight of the first glass panel 342. In some embodiments, instead of a pair of vertical supports 376, 378, a single vertical support or more than two vertical supports can extend to the top surface 380. In some embodiments, a pair of gasket retaining flanges 382, 384 can extend outwardly from an outer surface of the u-shaped body portion 374. In an example, the gasket can be formed from a flexible material and can be inserted into the third channel 364. Upon insertion into the third channel 364, the gasket retaining flanges 382, 384 can be deflected and then can expand upon insertion into the third channel 364, helping to retain the first gasket 370 in the third channel 364. In some embodiments, one or more pane retaining flanges 386, 388 can extend from an inner sidewall of the u-shaped body portion 374. As depicted, the pane retaining flanges 386, 388 can extend from both inner side-walls of the u-shaped body portion 374, however only pane retaining flanges 386, 388 are discussed for sake of simplicity. As depicted, the pane retaining flanges 386, 388 can be formed from a deformable and/or flexible material, which in some embodiments can be the same material that forms the gasket 370. As depicted, the pane retaining flanges 386, 388 can extend toward the other sidewall of the u-shaped body portion 374 and can be configured to deflect upon insertion of the first glass panel 342, thus creating a seal.

In some embodiments, the second gasket 372 can include a u-shaped body portion 390, which can be inserted into the fourth channel 366. As depicted, a base of the u-shaped body portion 374 can extend to a bottom surface 392 of a body portion of the middle cross-member 348. In some embodiments, a pair of gasket retaining flanges 394, 396 can extend outwardly from an outer surface of the u-shaped body portion 390. In an example, the gasket 372 can be formed from a flexible material and can be inserted into the fourth channel 366. Upon insertion into the fourth channel 366, the gasket retaining flanges 394, 396 can be deflected and can then expand upon insertion into the fourth channel 366, helping to retain the second gasket 372 in the fourth channel 366. In some embodiments, one or more pane retaining flanges 398, 400 can extend from an inner sidewall of the u-shaped body portion 390. As depicted, the pane retaining flanges 398, 400 can extend from both inner side-walls of the u-shaped body portion 390, however only pane retaining flanges 398, 400 are discussed for sake of simplicity. As depicted, the pane retaining flanges 398, 400 can be formed from a deformable and/or flexible material, which in some embodiments can be the same material that forms the gasket 372. As depicted, the pane retaining flanges 398, 400 can extend toward the other sidewall of the u-shaped body portion 390 and can be configured to deflect upon insertion of the second glass panel 344, thus creating a seal.

It should be understood that references to a single element are not so limited and may include one or more of such element. It should also be understood that the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present teachings not be limited to the particular examples illustrated by the drawings and described in the specification as the best mode presently contemplated for carrying out the teachings of the present disclosure, but that the scope of the present disclosure will include any embodiments falling within the foregoing description and the appended claims.

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "embodiments," "one embodiment," or "an embodiment," or the like, means that a particular feature, structure, or characteristic described in connection with the embodiment is included in at least one embodiment. Thus, appearances of the phrases "in various embodiments," "in embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional. Any directional references (e.g., plus, minus, upper, lower, upward, downward, left, right, leftward, rightward, top, bottom, above, below, vertical, horizontal, clockwise, and counterclockwise) are used for identification purposes to aid the reader's understanding of the present disclosure, and do not create limitations, particularly as to the position, orientation, or use of embodiments.

Although only certain embodiments have been described above with a certain degree of particularity, those skilled in the art could make numerous alterations to the disclosed embodiments without departing from the scope of this disclosure. Joinder references (e.g., attached, coupled, connected, and the like) are to be construed broadly and may include intermediate members between a connection of elements, relative movement between elements, and/or various types of connections. As such, joinder references do not necessarily imply that two elements are directly connected/coupled and in fixed relation to each other. The use of "e.g." throughout the specification is to be construed broadly and is used to provide non-limiting examples of embodiments of the disclosure, and the disclosure is not limited to such examples. It is intended that all matter contained in the above description or shown in the accompanying drawings shall be interpreted as illustrative only and not limiting. Changes in detail or structure may be made without departing from the present disclosure.

What is claimed is:

1. A fencing assembly, comprising:

a first vertical support member having a thru hole;

a second vertical support member having at least one blind hole;

a top cross-member including a first channel, the top cross-member extending between the first vertical support member and the second vertical support member;

a first planar barrier received in the first channel and confined on a first side of the first planar barrier by the first vertical support member and confined on a second side of the first planar barrier by the second vertical support member;

a bottom cross-member including a second channel;

a second planar barrier received in the second channel and confined on a first side of the second planar barrier by the first vertical support member and confined on a second side of the second planar barrier by the second vertical support member; and a middle cross-member including a third channel opposing the first channel and a fourth channel opposing the second channel wherein the third channel receives the first planar barrier and the fourth channel receives the second planar barrier.

2. The fencing assembly of claim 1, further comprising a bottom support member extending between a third end at the first vertical support member and a fourth end at the second vertical support member to define a bottom of the fencing assembly.

3. The fencing assembly of claim 2 wherein the third end and the fourth end are both cut at a forty-five degree angle.

4. The fencing assembly of claim 3 wherein the first and second vertical support members each have bottom ends that are cut at a forty-five degree angle to meet the third end and the fourth end forming a ninety degree angle between the vertical support members and the bottom support member.

5. The fencing assembly of claim 1 wherein a first end of the middle cross-member is received in the thru hole and a second end of the middle cross-member is received in the at least one blind hole.

6. The fencing assembly of claim 5, further comprising an end plate mounted to the middle cross-member at the first end of the middle cross-member.

7. The fencing assembly of claim 6 wherein the end plate is flush with an outside wall of the first vertical support member.

8. The fencing assembly of claim 1, further comprising a first hole at a bottom of the first vertical support member into which a first distal end of the bottom cross-member is inserted.

9. The fencing assembly of claim 8 wherein the at least one blind hole is multiple blind holes including a second hole within the second vertical support member into which a second distal end of the bottom cross-member is inserted.

10. The fencing assembly of claim 9, further comprising a third hole within the first vertical support member into which a first distal end of the top cross-member is inserted.

11. The fencing assembly of claim 10 wherein the multiple blind holes include a fourth hole within the second vertical support member into which a second distal end of the top cross-member is inserted.

12. The fencing assembly of claim 11 wherein the first hole and the third hole are blind holes.

13. A fencing assembly, comprising:

a frame comprising:

a first vertical support member having a thru hole;

a second vertical support member having at least one blind hole;

a top cross-member including a first channel, the top cross-member extending between the first vertical support member and the second vertical support member;

a bottom cross-member including a second channel; and a middle cross-member including a third channel opposing the first channel and a fourth channel opposing the second channel, and wherein a first end of the middle cross-member is received in the thru hole and a second end of the middle cross-member is received in the at least one blind hole.

14. The fencing assembly of claim 13, further comprising a first planar barrier received in the first channel and confined on a first side of the first planar barrier by the first vertical support member and confined on a second side of the first planar barrier by the second vertical support member.

15. The fencing assembly of claim 14, further comprising a second planar barrier received in the second channel and confined on a first side of the second planar barrier by the first vertical support member and confined on a second side of the second planar barrier by the second vertical support member.

16. The fencing assembly of claim 15 wherein the third channel passes over the first planar barrier and the fourth channel passes over the second planar barrier.

17. The fencing assembly of claim 13, further comprising a bottom support member extending between the first vertical support member and the second vertical support member to define a bottom of the frame.

18. The fencing assembly of claim 13, further comprising an end plate mounted to the first end of the middle cross-member.

19. The fencing assembly of claim 13, further comprising a first hole at a bottom of the first vertical support member into which a first distal end of the bottom cross-member is inserted.

20. The fencing assembly of claim 19 wherein the at least one blind hole is multiple blind holes including a second hole within the second vertical support member into which a second distal end of the bottom cross-member is inserted.

* * * * *